United States Patent [19]

Haskew et al.

[11] 4,302,054

[45] Nov. 24, 1981

[54] CUTTER UNIT ASSEMBLIES FOR EXCAVATING MACHINES AND TO EXCAVATING MACHINES INCLUDING CUTTER UNIT ASSEMBLIES

[75] Inventors: Francis A. Haskew; Leslie A. Jones, both of Burton-on-Trent; Alan R. Morris, Eggington; Miklos Tothfalusi; Derek Plummer, both of Burton-on-Trent, all of England

[73] Assignee: Coal Industry (Patents) Limited, London, England

[21] Appl. No.: 99,097

[22] Filed: Nov. 30, 1979

[30] Foreign Application Priority Data

Dec. 15, 1978 [GB] United Kingdom ..... 48636/78

[51] Int. Cl.[3] ..... E21D 9/08

[52] U.S. Cl. ..... 299/31; 299/33; 299/75

[58] Field of Search ..... 299/31, 33, 64, 75, 299/90, 56

[56] References Cited

U.S. PATENT DOCUMENTS

| | | | |
|---|---|---|---|
| 3,404,920 | 10/1968 | Tabor | 299/31 |
| 3,545,811 | 12/1970 | Montacie | 299/90 |
| 3,784,257 | 1/1974 | Lauber et al. | 299/31 |
| 4,136,910 | 1/1979 | Plummer | 299/75 X |

FOREIGN PATENT DOCUMENTS

| | | | |
|---|---|---|---|
| 1251545 | 5/1969 | United Kingdom . | |
| 1322749 | 10/1970 | United Kingdom . | |
| 1450323 | 3/1974 | United Kingdom . | |
| 1488489 | 10/1974 | United Kingdom . | |
| 1537353 | 2/1976 | United Kingdom . | |
| 374450 | 3/1973 | U.S.S.R. | 299/33 |
| 617593 | 7/1978 | U.S.S.R. | 299/75 |

*Primary Examiner*—Ernest R. Purser

*Attorney, Agent, or Firm*—Stevens, Davis, Miller & Mosher

[57] ABSTRACT

The cutting machine body comprises a non-rotary housing mounted on a slideway and a boom carrying rotary housing rotatably supported by annular support means arranged adjacent to a radially outer margin of the body, drive means being provided on the non-rotary housing for rotating the boom carrying rotary housing.

9 Claims, 32 Drawing Figures

FIG. 1
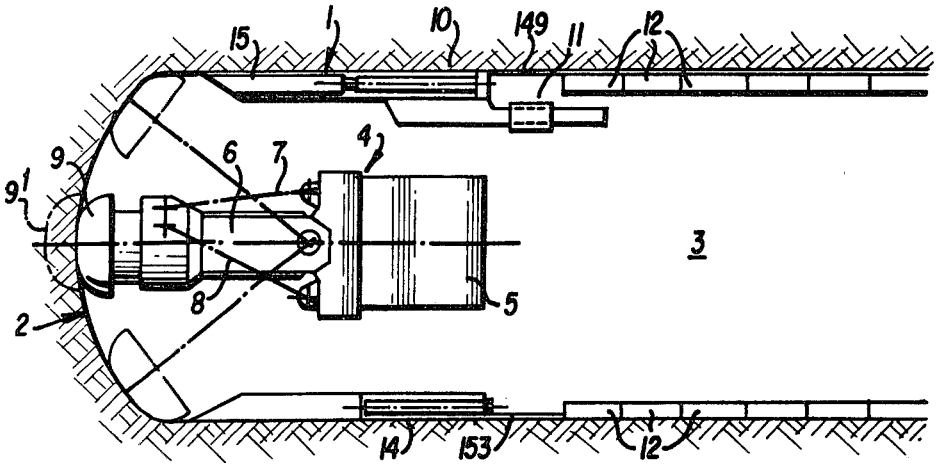
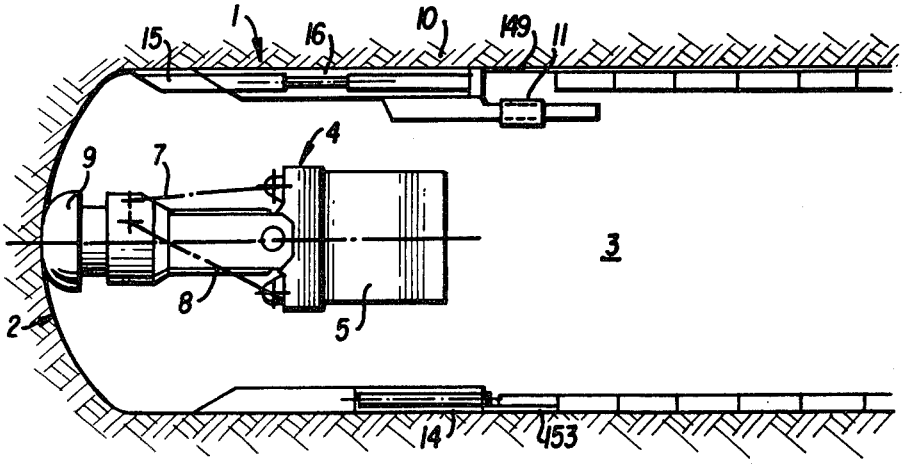
FIG. 2

CUTTER UNIT ASSEMBLIES FOR EXCAVATING MACHINES AND TO EXCAVATING MACHINES INCLUDING CUTTER UNIT ASSEMBLIES

This invention relates to cutter unit assemblies for excavating machines and to excavating machines including cutter unit assemblies.

In particular, although not exclusively, the present invention relates to cutter unit assemblies for rock excavating machines which in use cut rock from working faces to extend underground roadways or tunnels, at least a part of the cut rock boundary being of arcuate form.

One such prior known excavating machine disclosed in British Pat. No. 1,488,489 comprises a cutter unit assembly including a pivotally mounted, forwardly directed boom and a stay assembly anchorable in the roadway or tunnel, the boom being supported on a boom support member movable about an axis extending along the roadway such that a rotary cutter mounted on the boom cuts the arcuate form of the rock boundary. The boom support member includes a driven shaft supported for rotation about the roadway axis such that when the shaft is rotated the boom is swung about the roadway axis. Unfortunately, with such a cutting unit assembly construction the entire weight of the boom including the cutter and cutter drive mechanism, and the reaction thrusts generated during cutting have to be borne by the relatively small diameter shaft. This disadvantage of the known construction tends to make the known machine unsuitable for the arduous conditions encounted in hard rock cutting installations.

An object of the present invention is to provide a cutting unit assembly for an excavating machine which tends to overcome the above mentioned disadvantage and which is more suitable for working in hard rock cutting conditions.

According to one aspect of the present invention, a cutting unit assembly for an excavating machine which in use cuts rock from a working face to extend an underground roadway or tunnel, comprises a body and a boom adapted to carry rock cutter means, the body comprising a non-rotary portion presenting annular support means which in use are arrangeable generally co-axially with the longitudinal axis of the roadway or tunnel, and a rotary portion for supporting the boom and having annular supported means for co-operation with the annular support means of the non-rotary portion of the body, the annular support and supported means being arranged adjacent to a radially outer margin of the body, the cutting unit assembly further comprising drive means for rotating the rotary portion of the body.

Preferably, the annular support means includes an annular bearing.

Advantageously, the non-rotary portion of the body comprises at least one drive motor and at least one driven gear wheel and the rotary portion of the body comprises an annular gear drivably engageable by the driven gear wheel.

Conveniently, the radially outer margin of the non-rotary portion of the body presents an annular forwardly directed projection arranged to co-operate with an annular rearwardly directed projection presented by the radially outer margin of the rotary portion of the body.

Preferably, at least one seal is provided between the co-operating projections.

Advantageously, a relatively radially inner margin of the non-rotary portion of the body presents a cylindrical formation which in use is arrangeable generally co-axially with the longitudinal axis of the roadway or tunnel and the rotary portion of the body has an annular formation for co-operation with the cylindrical formation.

Preferably, at least one seal is provided between the cylindrical and annular formations.

Advantageously, the or each drive motor is mounted on the rear of the non-rotary portion and an extended drive shaft is provided for engagement with the drive wheel.

Conveniently, the rotary portion of the body comprises a trunnion for pivotally supporting the boom, the pivotal axis of the trunnion being transverse to, and arranged to intersect the axis of rotation of the rotary portion.

According to another aspect of the present invention, an excavating machine for cutting rock from a working face to extend an underground roadway or tunnel comprises a cutting unit assembly as defined above.

One embodiment of the present invention will now be described with reference to the accompanying drawings, in which:

FIG. 1 is a diagrammatic side elevation of an excavating machine constructed in accordance with the present invention and comprising a cutting unit assembly and an outer shield assembly, the machine being shown in one operational position;

FIG. 2 is a diagrammatic side elevation similar to FIG. 1 but with the machine shown in a second operational position;

Figure 3:
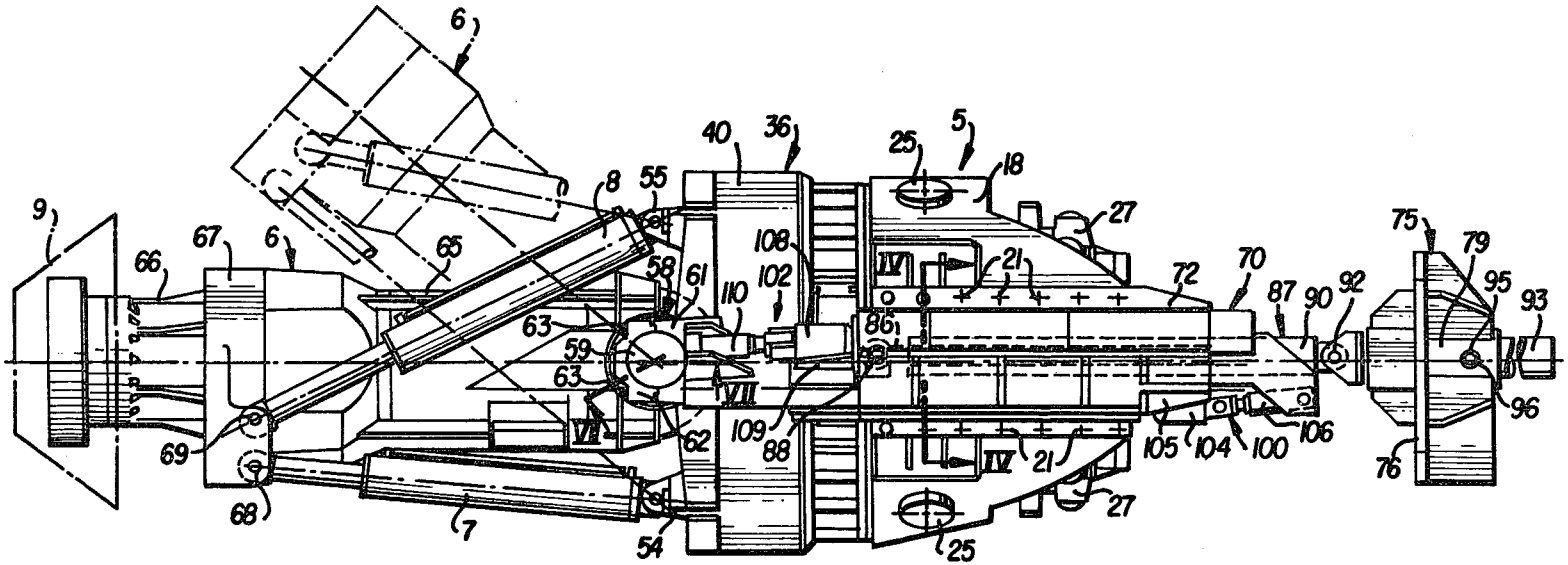
FIG. 3 is an incomplete side elevation of the cutting unit assembly of FIGS. 1 and 2 showing slide means for advancing the cutting unit assembly, and drawn on an enlarged scale.

FIGS. 1 and 2 of the drawing show diagrammatically a rock excavating machine 1 cutting rock from a working face 2 to extend a circular roadway or tunnel 3 in an underground mine. The excavating machine includes a cutting unit assembly 4 comprising a body 5, a boom 6 pivotally mounted at the front of the body and pivotable under the action of two pairs of hydraulic rams 7 and 8 (only the longitudinal axis of one ram of each pair is indicated in FIGS. 1 and 2), and a rotary cutter head 9 mounted on the front end of the boom. The machine also comprises a stay unit constituted by an outer shield assembly 10 (only the extreme lowermost and uppermost portions of which are shown in FIGS. 1 and 2) which extends around the whole of the recently exposed circular wall of the roadway or tunnel and which supports two slideways (not shown in FIGS. 1 and 2) for two slides (also not shown) mounted on the sides of the body of the cutting unit assembly, respectively, for advancing the cutting unit assembly relative to the outer shield assembly.

An erector device 11 mounted on the outer shield assembly erects support sections 12 in a space left immediately at the rear of the outer shield assembly upon the advance of the shield assembly under the action of a plurality of hydraulic rams 14 which are arranged around the bottom portion of the shield assembly and which use the previously set ring of support sections 12 as a buttress to react against the force required to advance the shield assembly.

In FIG. 1 the cutter head 9 is indicated in several alternative operational positions associated with its cutting of rock from the working face 2. When all the strip of rock has been excavated the cutter head is sumped into the newly exposed rock face as indicated at 9' and the whole cutting procedure repeated to excavate the next strip of rock from the working face. During this latter cutting operation the newly exposed roof of the roadway or tunnel is shielded by forepoling beam arrangements 15 which are urged towards the newly exposed rock face by hydraulic rams 16. The beam arrangements 15 shield the upper portions of the newly exposed rock face and wall until the remainder of the outer shield assembly is further advanced. During advance of the outer shield assembly the rams 16 allow the reaction of the extended beams with the working face 2 to urge the beams towards their withdrawn positions.

Details of the excavating machine together with its operation will be given in the following part of the specification with reference to FIGS. 3 to 31.

The cutting unit assembly will now be described in detail with reference to FIGS. 3 and 5 to 8 which show the body 5 to comprise a rear housing 18 having slideway means 20 secured to each side by bolts 21. The slideway means will be described in more detail later in the specification. The rear housing 18 is constructed in two sections for ease of transportation to the working site, the two sections being secured together by bolts 19 and each section comprising a central tube 22, a plurality of radially extending plates 23 and an outer cover 24 provided with removable hatches 25 for access during assembly. Four hydraulic motors 27 having extended drive shafts 28 are mounted on the rear section, the extended drive shafts extending through the housing 18 to drivably engage four gear wheels 30, respectively, which are supported in bearings 31 and 32 (see particularly FIG. 8) and which drivably engage a rotatable gear ring 34 fixedly mounted by bolts 35 onto a rotary front housing 36 constituting the leading part of the body 5 carrying the boom 6. The front housing comprises a circular front plate 38 integral with an outer cylindrical shell 40 extending as an annular lip projection 41 over a bearing ring 42 rotatably supporting the gear ring 34 to engage a co-operating annular lip projection 44 constituting a part of the cover 24 of the leading section of the rear housing 18. Seals 46 are provided in the joint between the shell 40 and the lip 44 and grease is used between the seals to prevent ingress of contaminants. The bearing ring 42 is secured to the cover 24 by support members 48 and bolts 50. A further seal 52 is provided on the radially inner margin of the front plate 38 where it slideably contacts the central tube 22.

Figure 7:
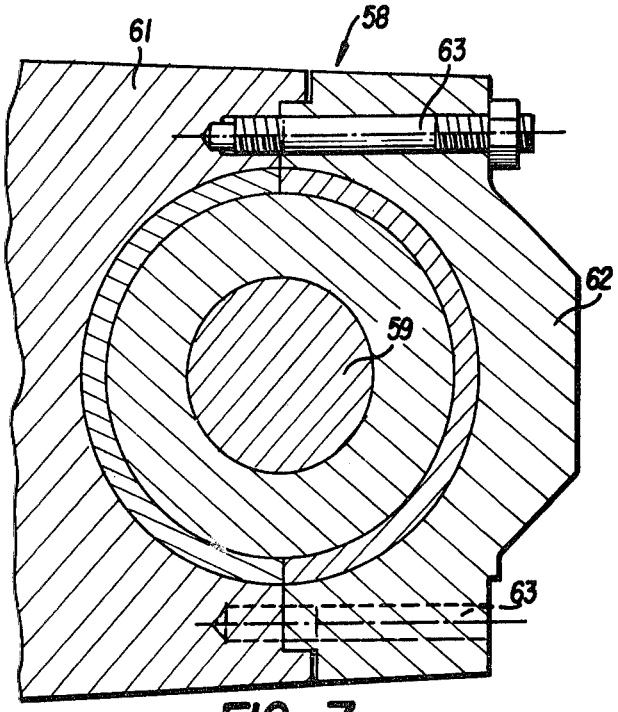
FIG. 7 is an incomplete section along line VII—VII of FIG. 5 drawn on an enlarged scale.
Figure 17:
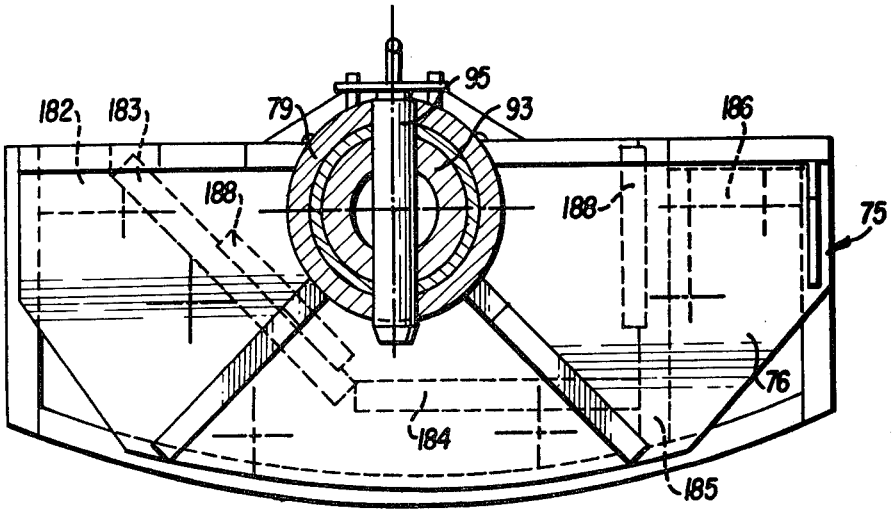
FIG. 17 is an incomplete section along line XVII—XVII of FIG. 14.
Figure 8:
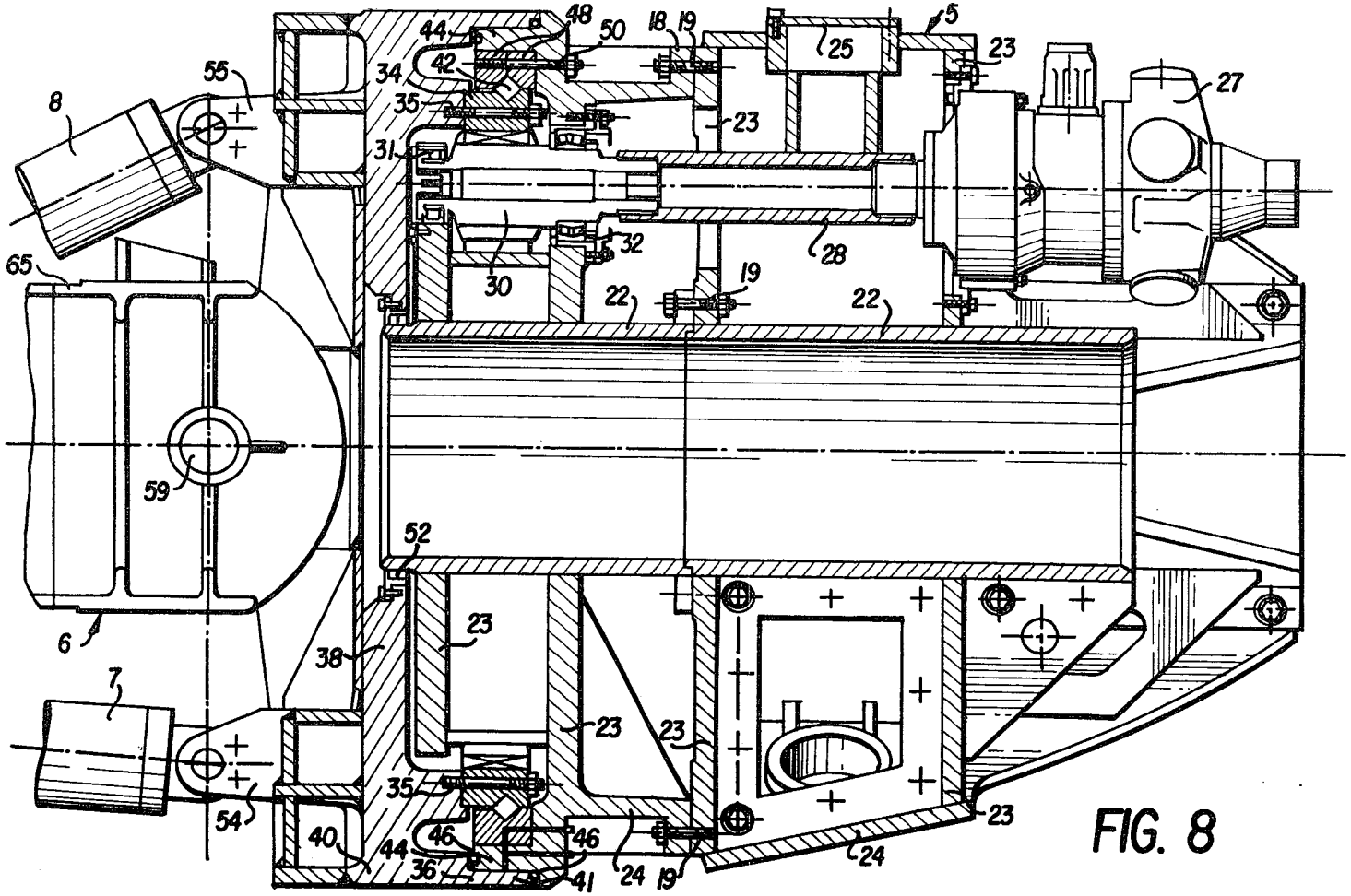
FIG. 8 is a longitudinal section through a part of the cutting unit assembly along line VIII—VIII of FIG. 6.
Figure 9:
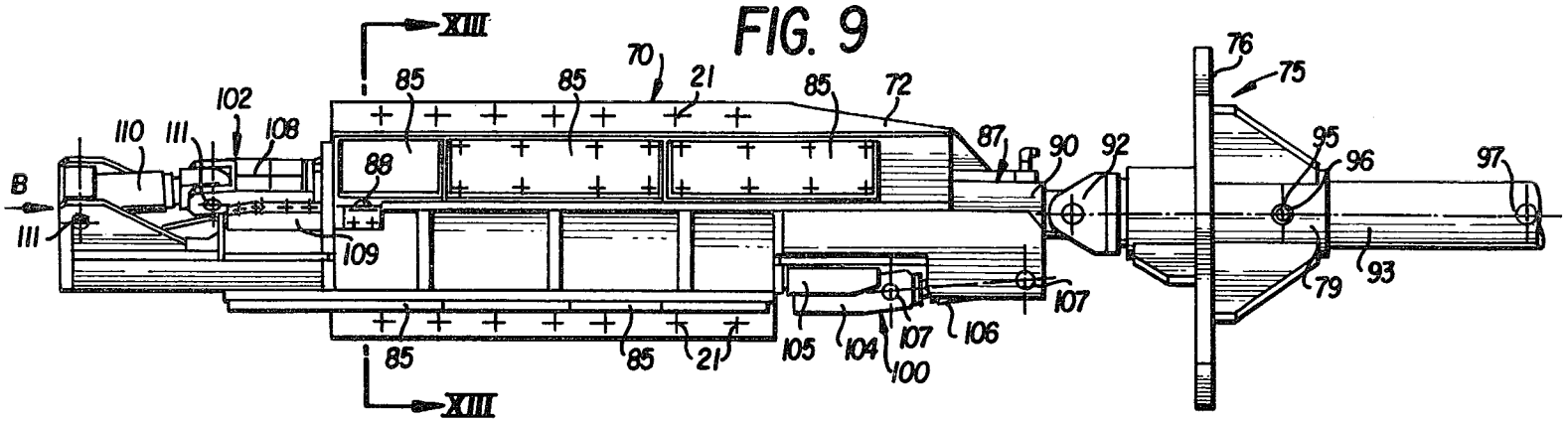
FIG. 9 is a side elevation of the slide means of FIG. 3 on an enlarged scale.

Two pairs of support brackets 54 and 55 are provided on the leading face of the front plate 38 to pivotally support the rearmost ends of the rams 7 and 8, respectively. Also, two trunnions 58 are provided on the leading face of the front plate 38 to pivotally support a shaft assembly 59 extending outwardly from the sides of the boom 6. FIG. 7 shows each trunnion to comprise two blocks 61 and 62 secured together by bolts 63, the block 61 being secured to the front plate 38.

The boom 6 comprises a main housing 65 within which is mounted a cutter head drive assembly (not shown) including a drive motor and gearbox having a driven output shaft 64 (see FIG. 5) housed within a housing extention 66, and drivably connected to the rotary cutter head 9 having rock cutting tools (not shown). The leading portion of the main boom housing 65 is provided with a yoke support 67 having pivotal mountings 68 and 69 for the foremost ends of the rams 7 and 8, respectively. The rearmost end of the main housing 65 is provided with the shaft assembly 59 pivotally supported in the trunnions 58. In FIG. 3 the boom 6 is indicated in two operational positions.

The slideway means 20 provided on each side of the body 5 of the cutting unit assembly comprises a slide component 70 having a vertical plate 72 fixedly secured by the bolts 21 to plate 73 on the body 5 and an adjustable anchor means 75 including plates 76 fixedly secured by bolts 78 to the rear end of a slideway component 82 fixedly mounted onto the outer shield assembly 10. The anchor means also comprises a tubular slideway element 79 having a cylindrical wear pad for guidably engaging a rod 93 described later in the specification.

The slide component 70 comprises a slide member which is tapered in cross-section (see particularly FIG. 4) to guidably, slidably engage the slideway component 82 fixedly mounted on the outer shield assembly 10. The slide member is constructed from a plurality of plates 81, 83, 84 and 89 welded together with the vertical plate 72 to form a box like structure. The plates 83 and 89 are provided with slide pads 85 for slidable engagement with the slideway component. Within the box like slide member is secured the free end of a piston rod 86 of a hydraulic ram 87, a pin 88 securing the piston rod 86 to the slide member. The cylinder 90 of the ram 87 is secured by a pin 92 to a rod 93 of the anchor means 75 which is normally locked in position relatively to the anchored plate 76 by a locking pin 95 alternatively engaged in one of three bores 96, 97 or 98 provided in the rod 93. The selection of the bore 97 to adjust the effective stroke of the ram 87 will be described later in the specification. The bore 98 is engaged by the locking pin 95 when it is desired to advance the slide component 70 farther than the normal operating advance to facilitate the removal of the pin 88 to release the ram 87 for servicing. The selection of the bore 96 permits the ram 87 to withdraw the cutting assembly to a relative safe region more remote from the working face than is normal during cutting to enable the cutter tools on the cutter head to be serviced.

The slide component 70 is provided with two wedge arrangements 100 and 102 mounted at opposite ends of the slide component and adapted to engage adjacent faces provided on the slideway component 82 to take up any tolerance clearances as explained later in the specification. The wedge arrangement 100 comprises a wedge shaped pad 104 slidable along the lower horizontal face of the slideway component and guidably movable against a co-operating reaction wedge member 105 under the action of a hydraulic ram 106 pivotally secured by pins 107 between the wedge pad 104 and the remainder of the slide component 70.

The wedge arrangement 102 comprises a wedge shaped pad 108 slidable along the upper inclined face of the slideway component and guidably movable against a co-operating reaction wedge member 109 under the action of a hydraulic ram 110 pivotally secured by pins 111 between the wedge pad 108 and the remainder of the slide component 70.

Figure 10:
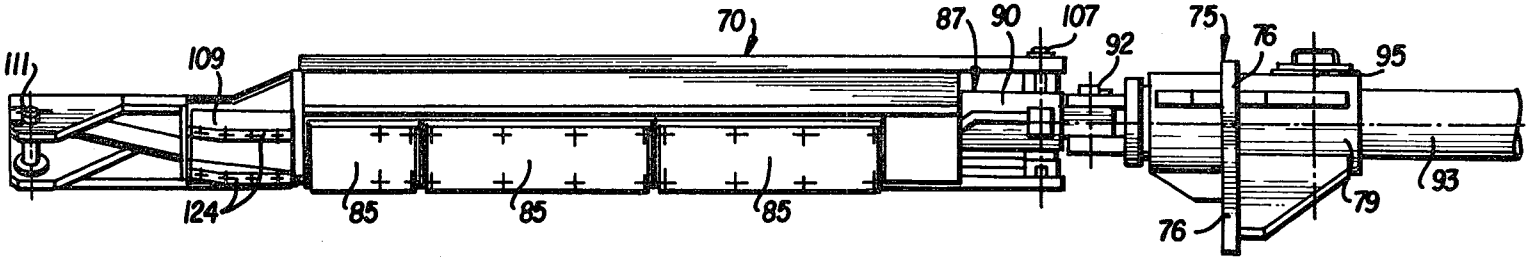
FIG. 10 is an incomplete plan of the slide means of FIG. 9, parts being omitted for the sake of clarity.
Figure 11:
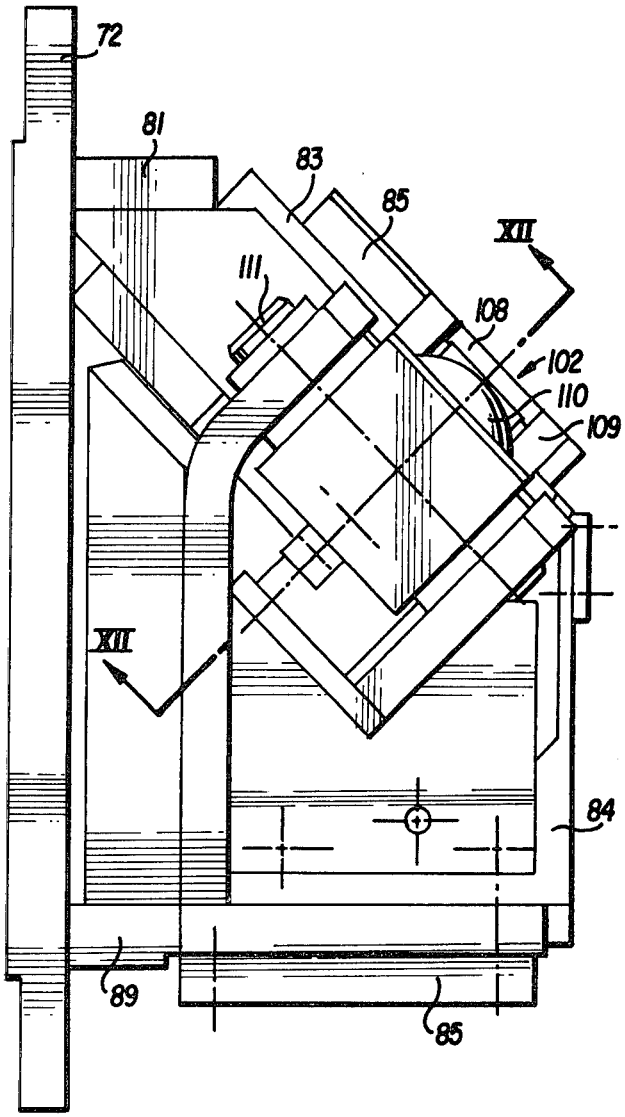
FIG. 11 is an end view of the slide means of FIG. 9 looking in the direction of arrow B.
Figure 12:
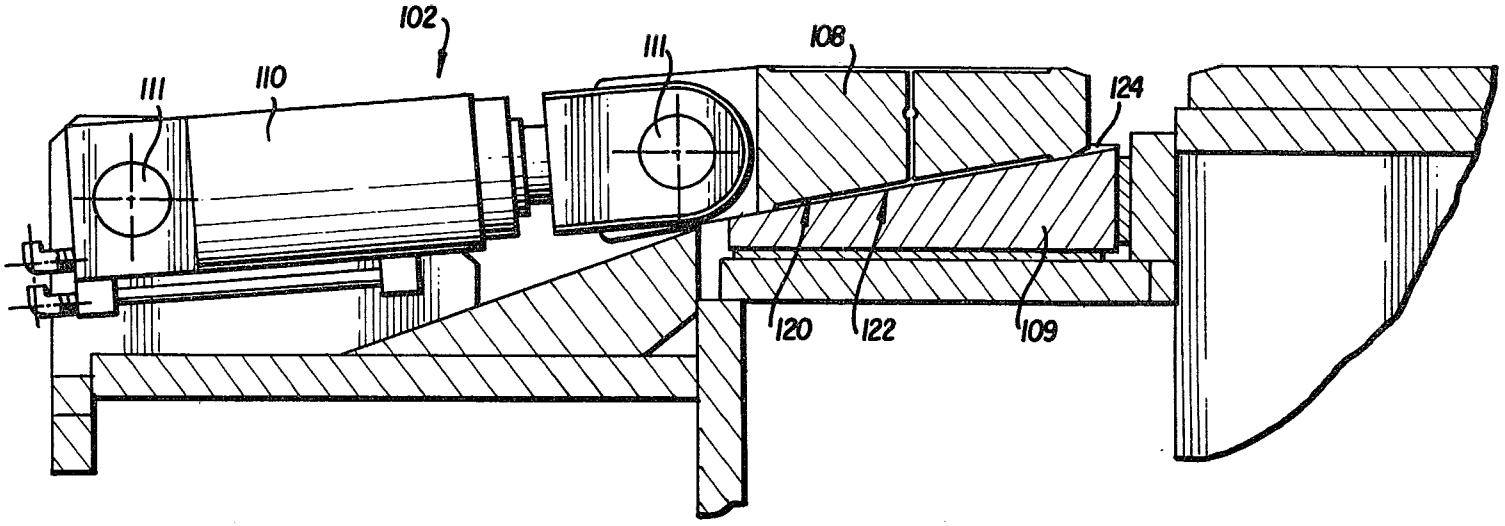
FIG. 12 is an incomplete section along line XII—XII of FIG. 11.
Figure 13:
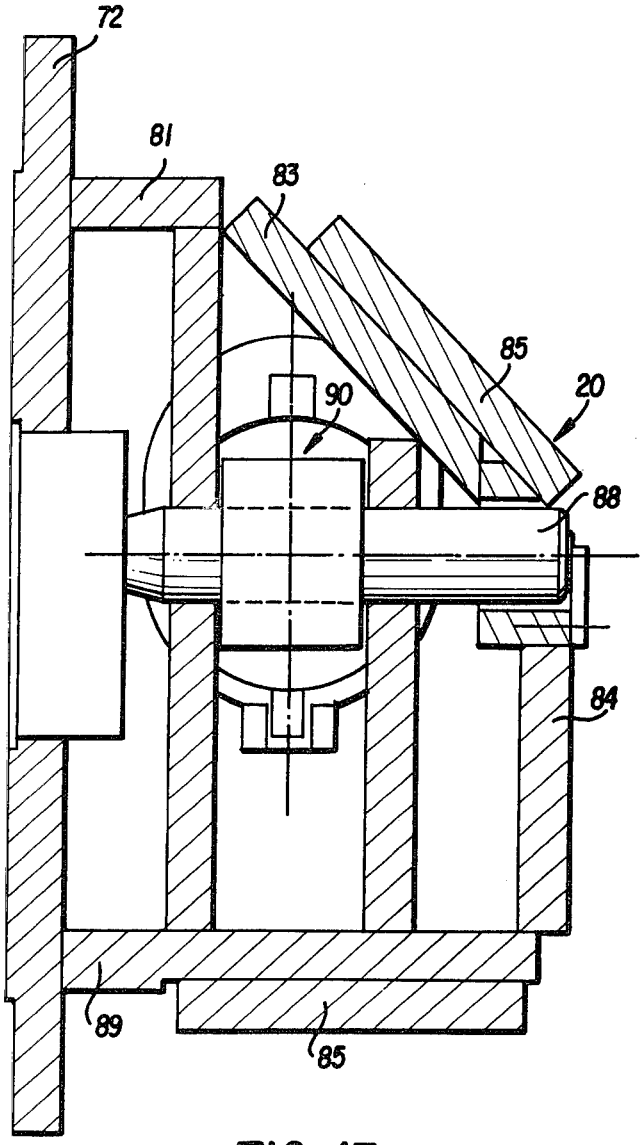
FIG. 13 is a section along line XIII—XIII of FIG. 9.
Figure 14:
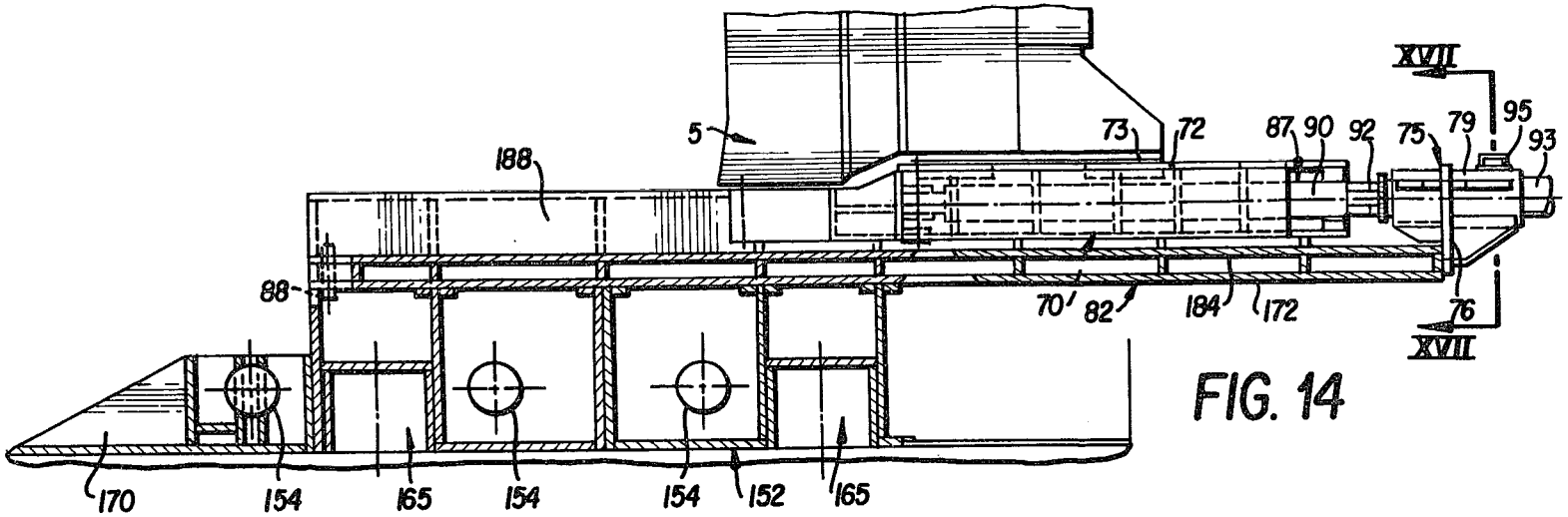
FIG. 14 is an incomplete plan of a side portion of the excavating machine showing the slide means and the adjacent portion of the outer shield assembly.
Figure 32:
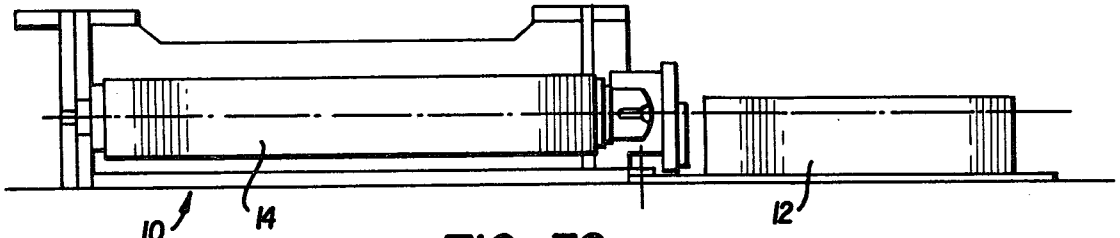
FIG. 32 is an incomplete section through a detail of FIG. 1 and shown on a greatly enlarged scale.
Figure 15:
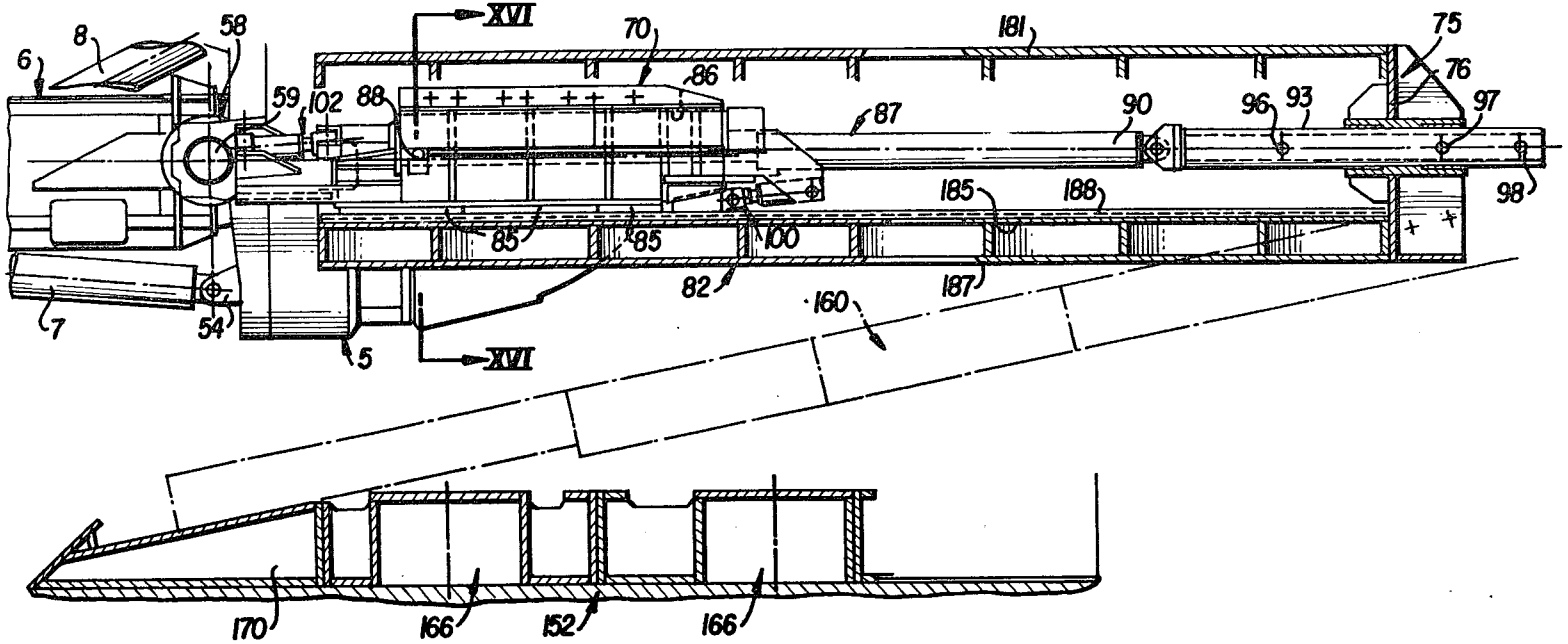
FIG. 15 is an incomplete side elevation of FIG. 14, the slide means being shown in an alternative operational position to that in FIG. 14.

The wedge arrangements 100 and 102 are of similar construction to each other and particularly FIG. 10 in which the wedge pad 108 and ram 110 have been omitted together with FIG. 12 show details of the wedge arrangement 102 including the co-operating wedge faces 120 and 122 and the guide flanges 124 provided on reaction wedge member 109 to longitudinally guide the movable wedge pad 108.

Operation of all the hydraulic rams on the excavating machine including those provided on the outer shield assembly to be described in detail later in this specification are controlled from a control panel (not shown) provided with a plurality of hydraulic control valves. Hydraulic pipe work immediately adjacent to some of the rams is shown on some of the Figures.

Figure 4:
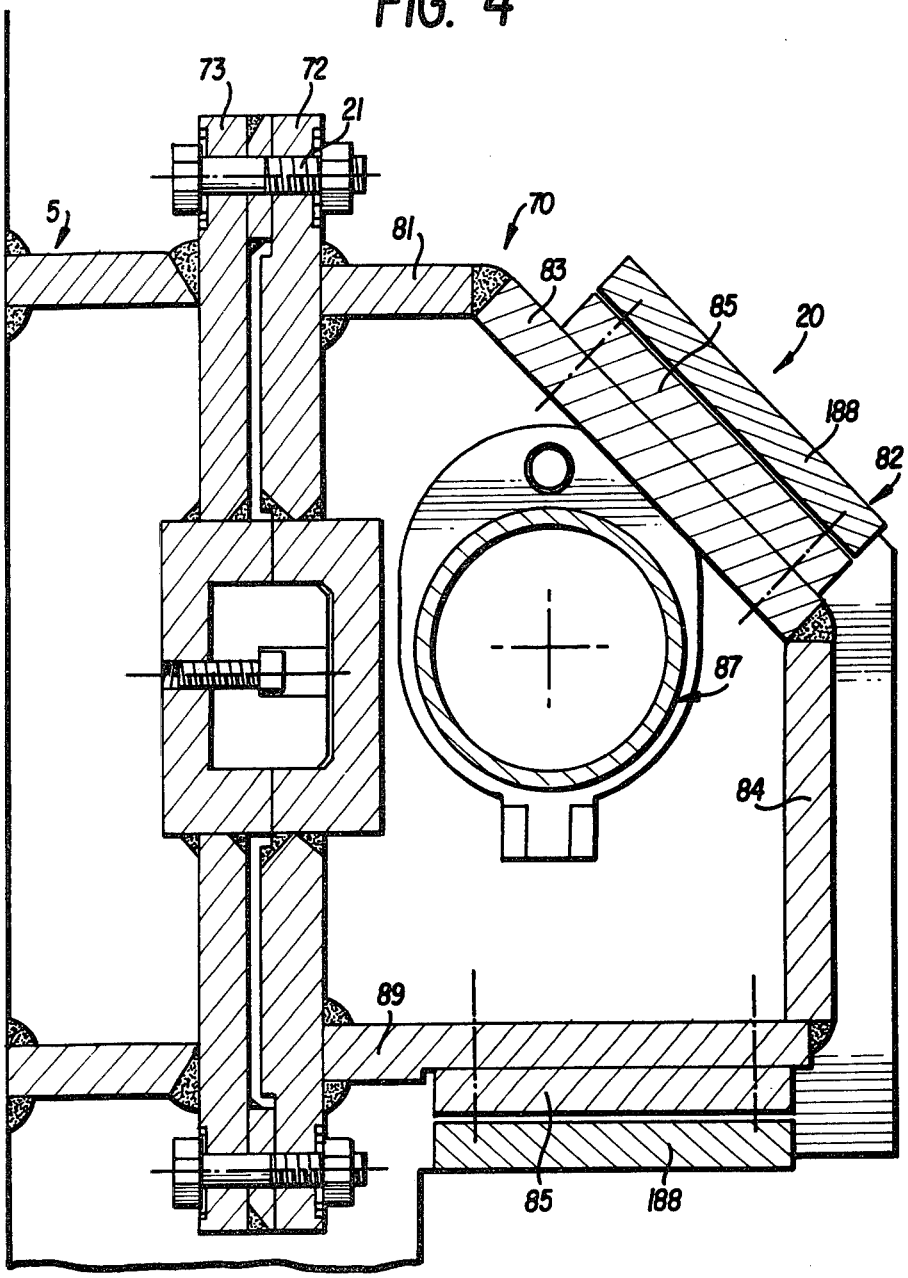
FIG. 4 is a section through the slide means along line IV—IV of FIG. 3 and drawn on an enlarged scale.
Figure 5:
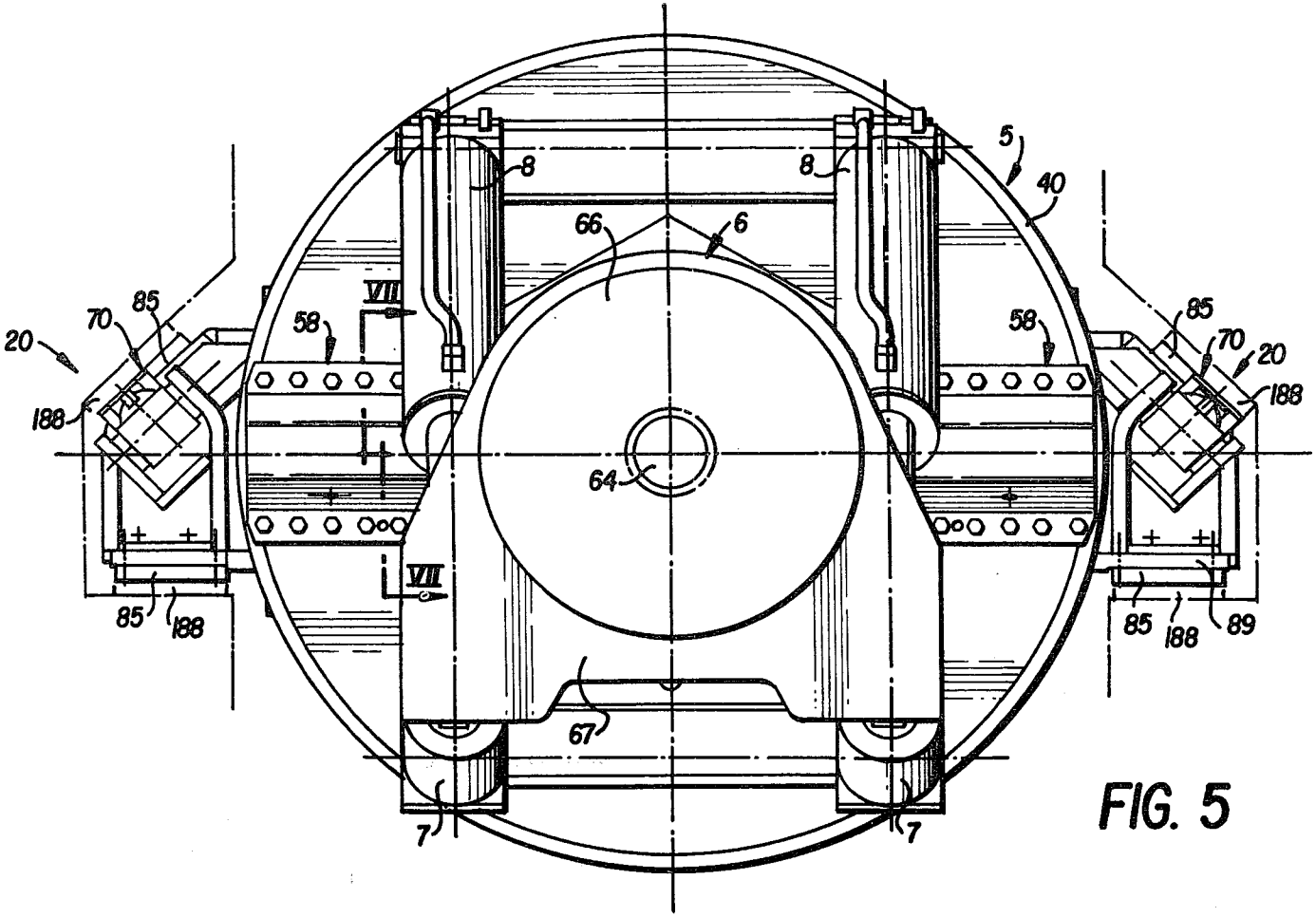
FIG. 5 is a front view of the cutting unit assembly of FIG. 3 including slide means on each side of the cutting unit.
Figure 6:
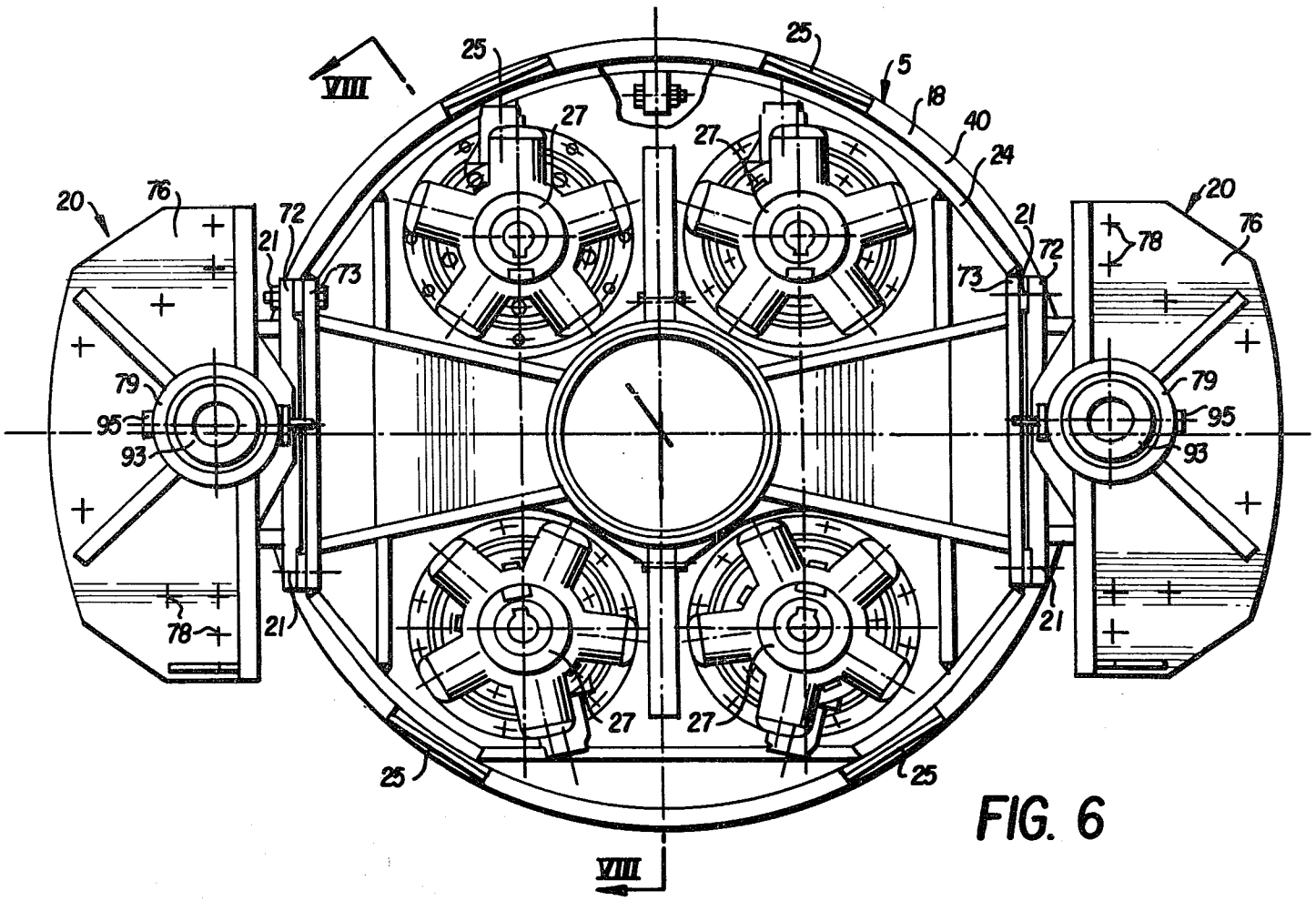
FIG. 6 is a rear view of the cutting unit assembly of FIG. 3.

The outer shield assembly 10 and the slideway components 82 will now be described in detail with reference to FIGS. 4 and 5 which show some detail of the slideway component construction 82 and particularly with reference to FIGS. 14 to 32.

Figure 18:
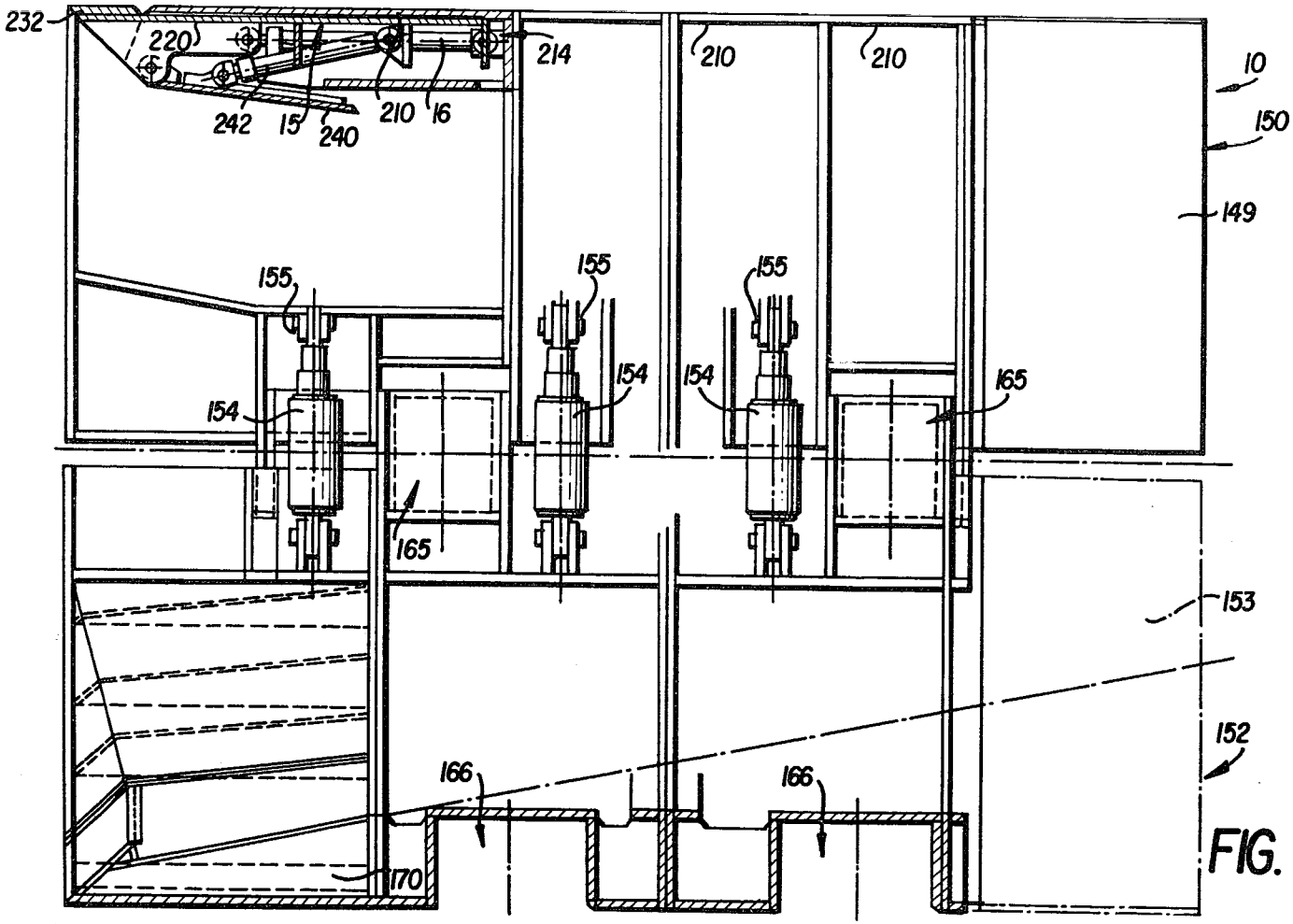
FIG. 18 is an incomplete longitudinal side elevation of the outer shield assembly, the cutting unit assembly being omitted for the sake of clarity.
Figure 19:
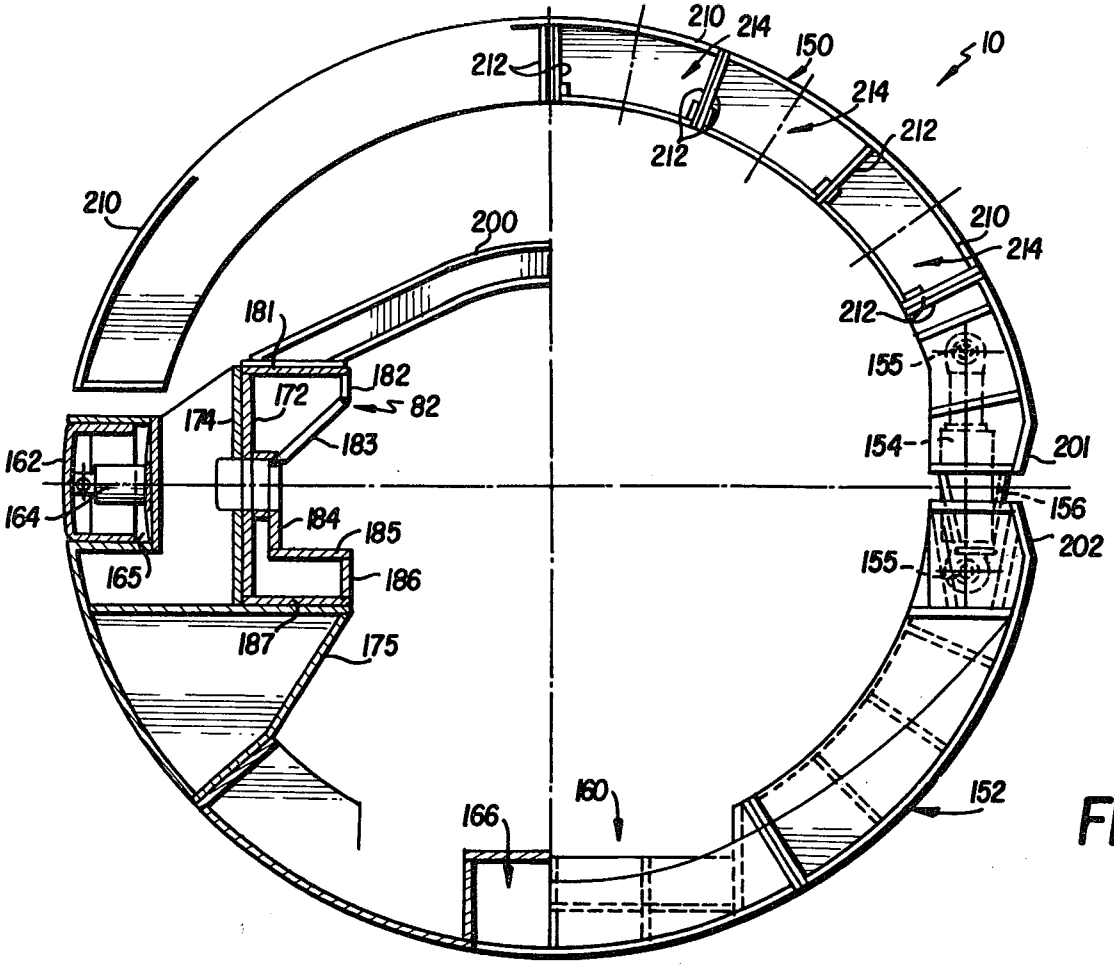
FIG. 19 is an incomplete rear view of the outer shield assembly of FIG. 18, the left hand half of the drawing being a cross-sectional view.
Figure 20:
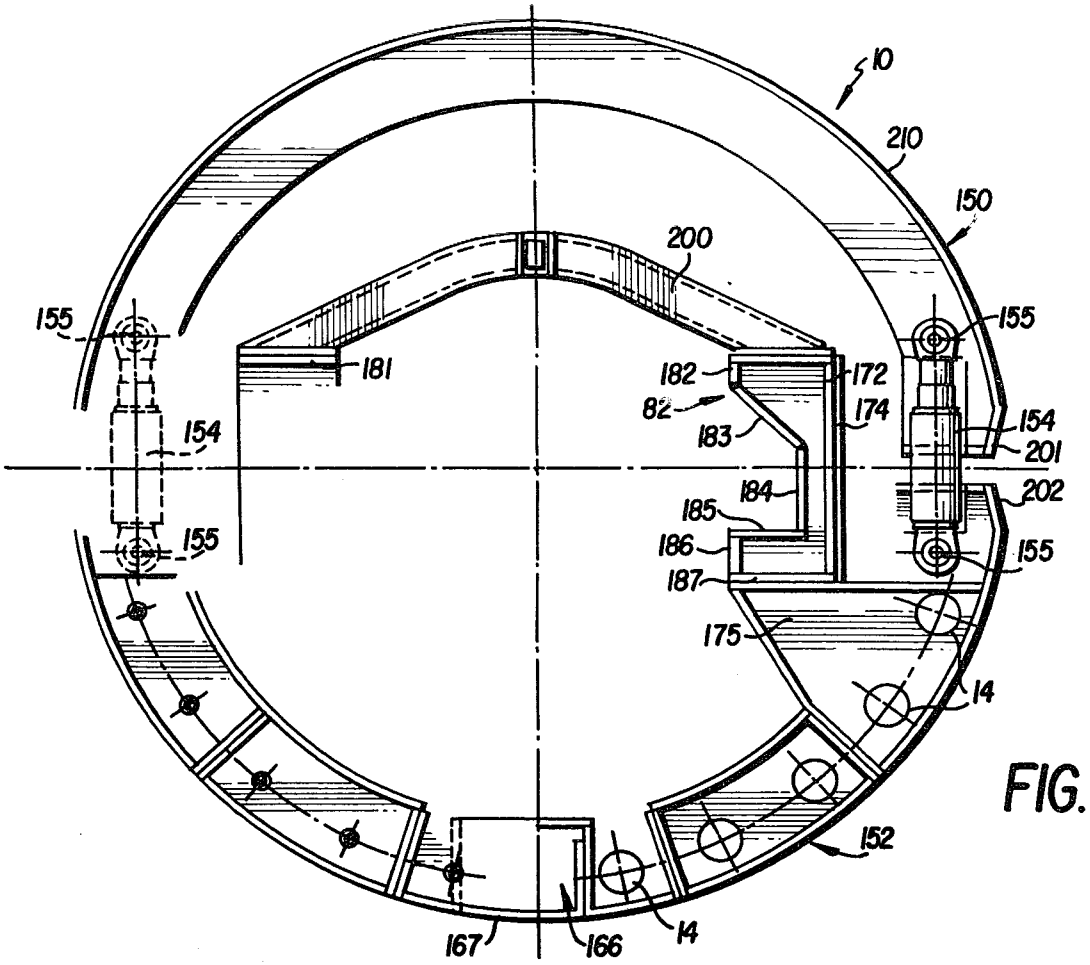
FIG. 20 is an incomplete front view of the outer shield assembly of FIG. 18, the right hand half of the drawing being a cross-sectional view.
Figure 21:
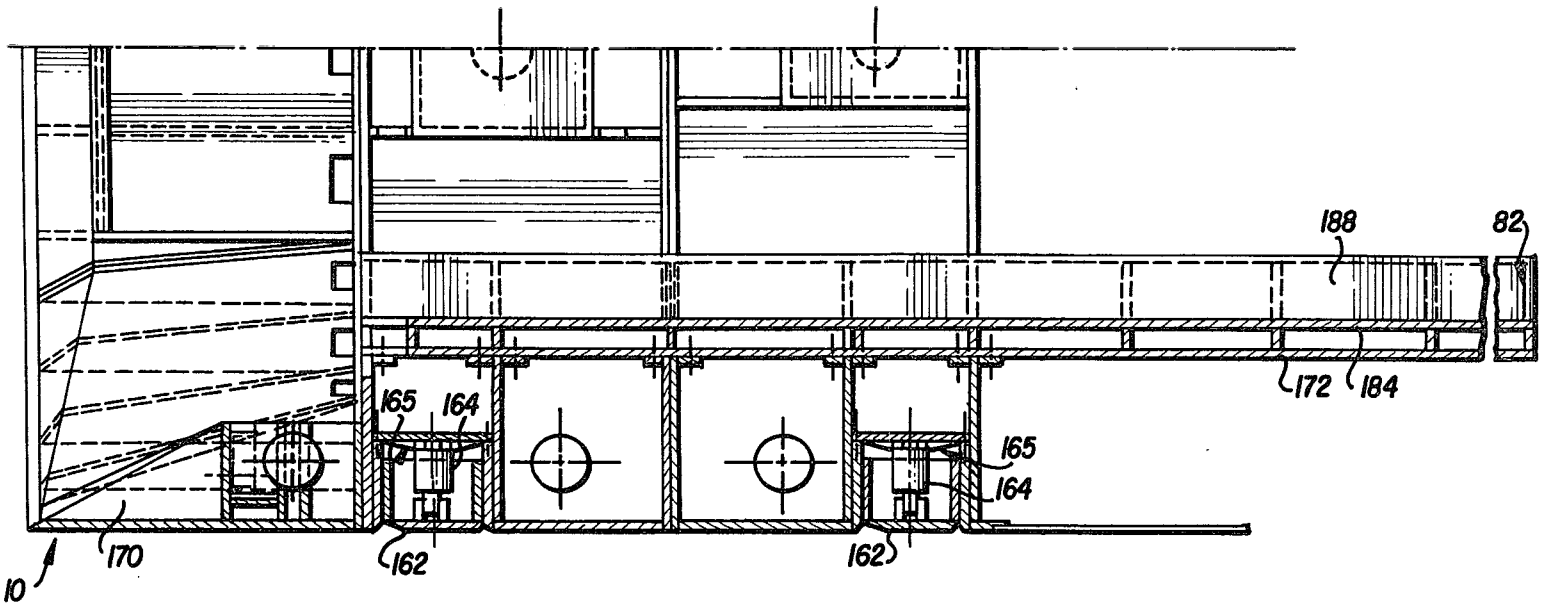
FIG. 21 is an incomplete section of a part of one side of the outer shield assembly of FIG. 18, the section being taken horizontally through the longitudinal axis.
Figure 22:
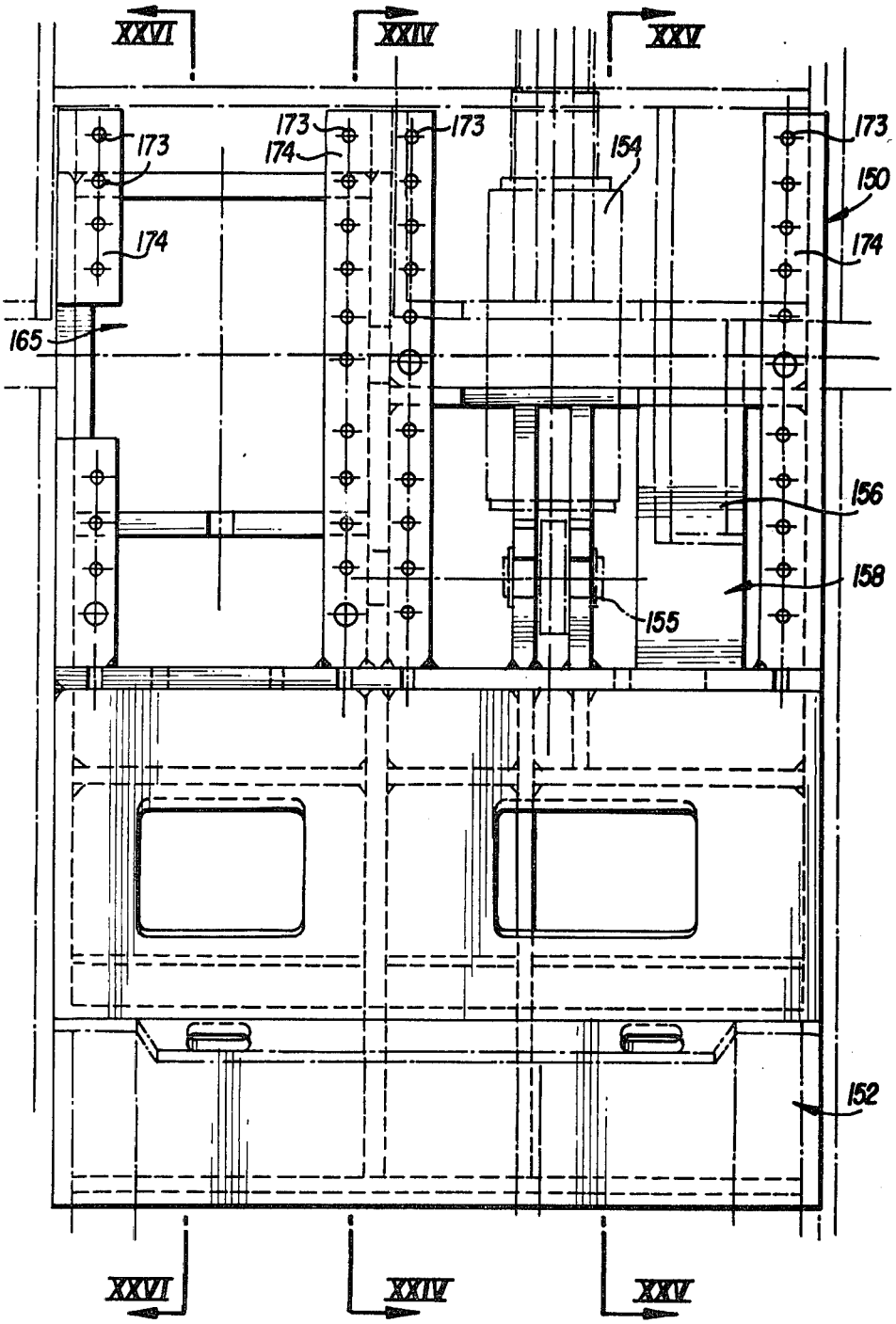
FIG. 22 is an incomplete side elevation of a detail of the outer shield assembly.
Figure 23:
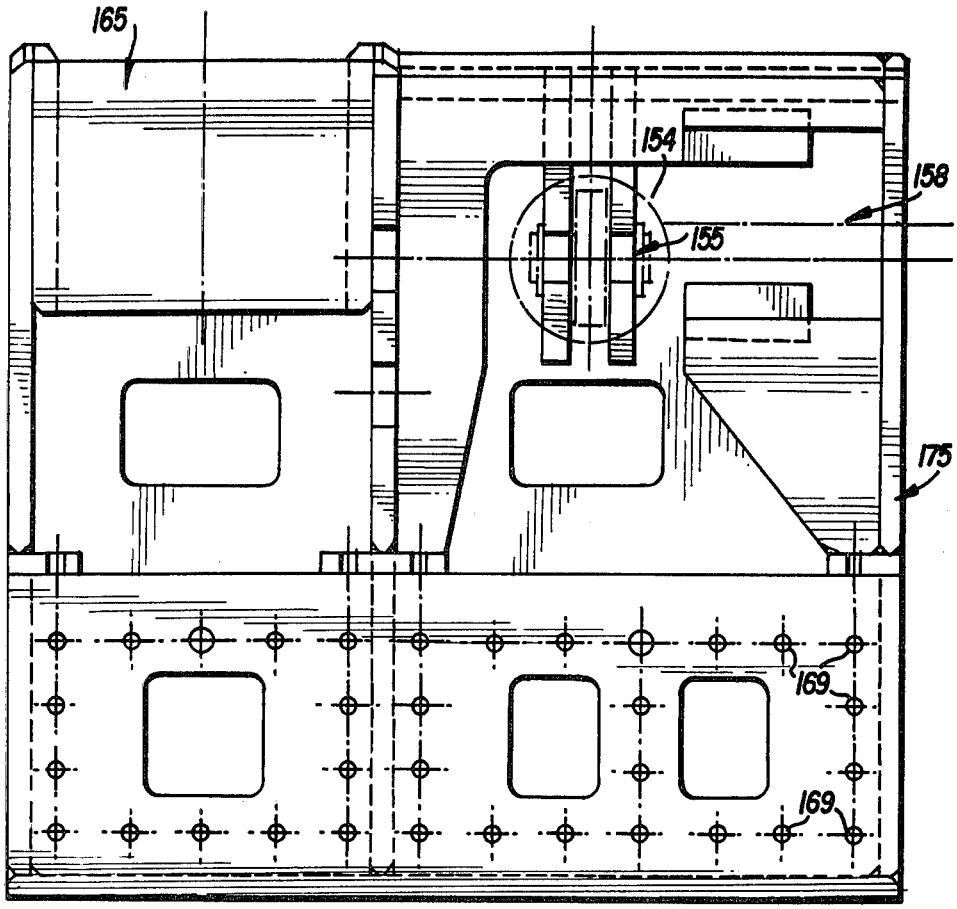
FIG. 23 is a plan of the detail of FIG. 22.
Figure 24:
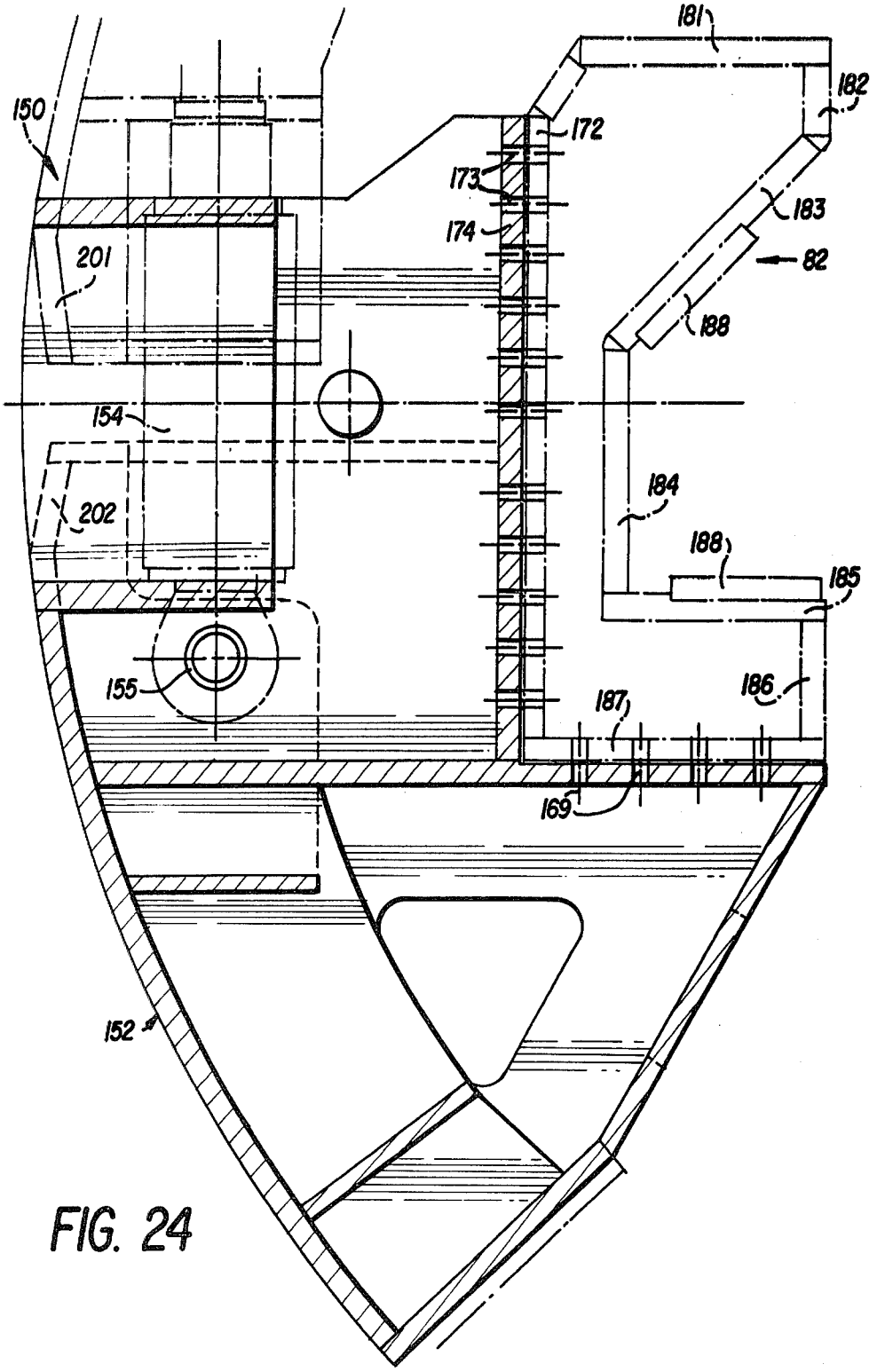
FIG. 24 is a section along line XXIV—XXIV of FIG. 22.
Figure 25:
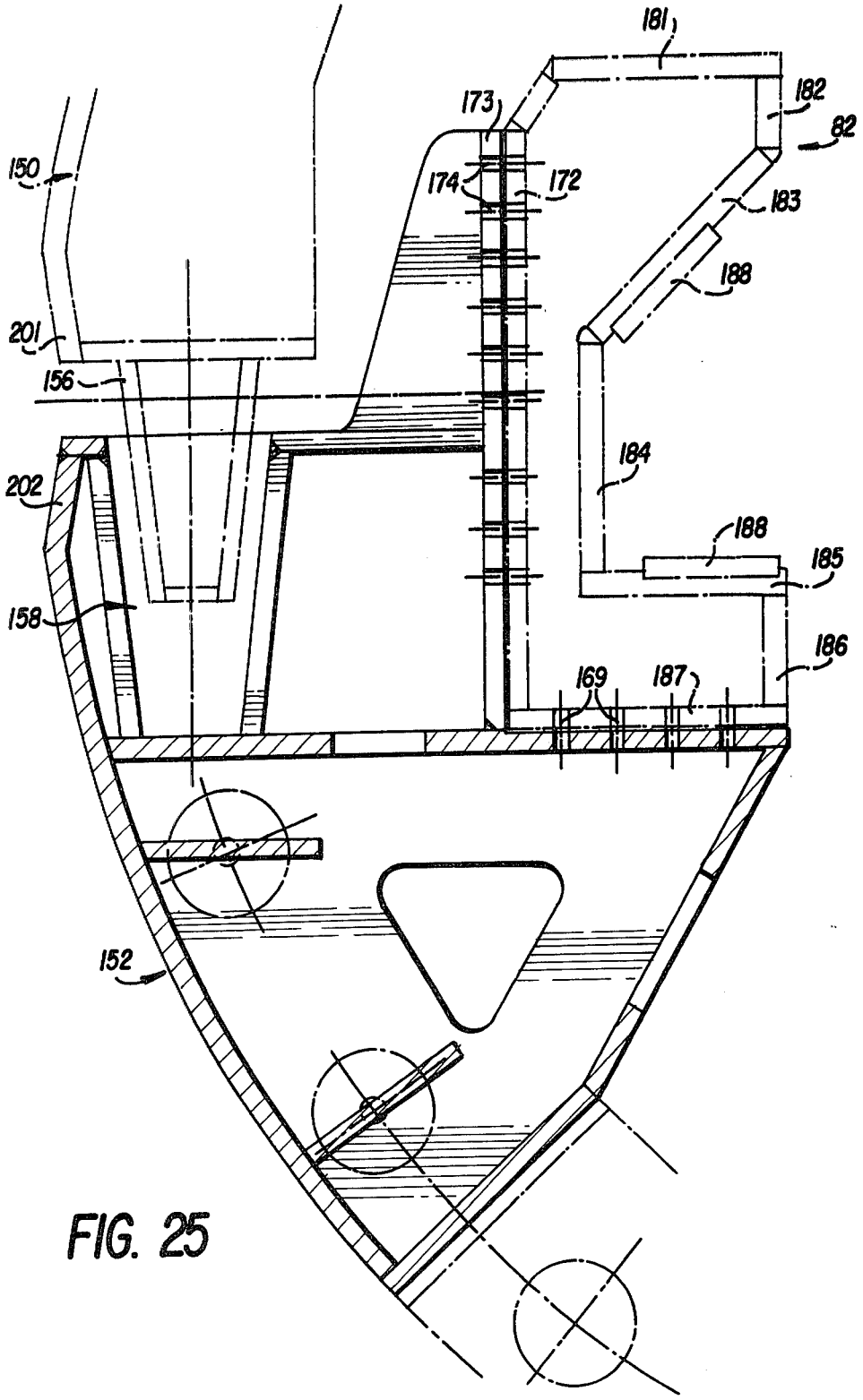
FIG. 25 is a section along line XXV—XXV of FIG. 22.
Figure 26:
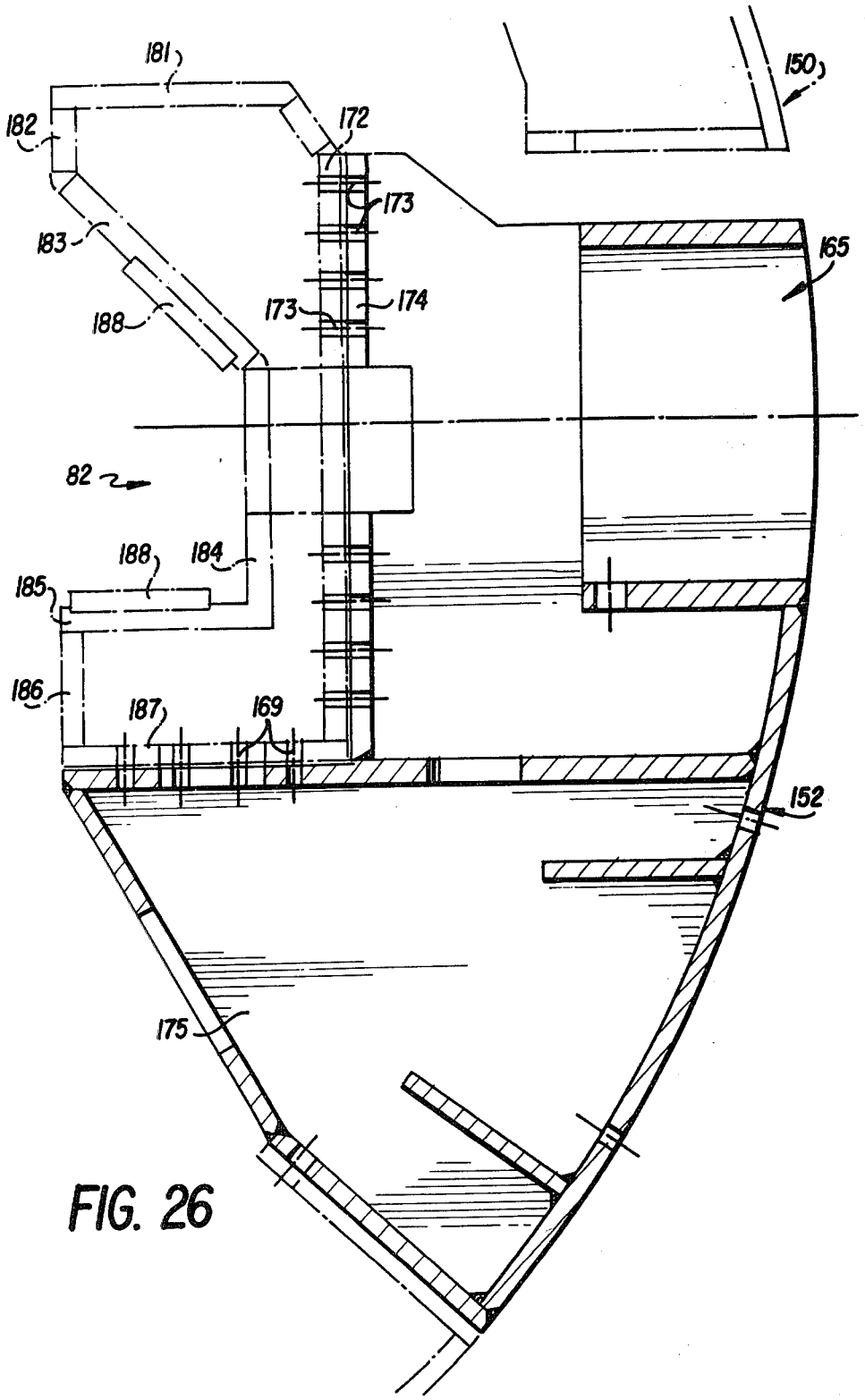
FIG. 26 is a section along line XXVI—XXVI of FIG. 22.

FIGS. 18, 19 and 20 show the outer shield assembly 10 to be of a split, hollow, generally cylindrical form comprising an upper shield assembly 150 and a lower shield assembly 152 interconnected along each side by three vertical hydraulic rams 154 pivotally mounted to the upper and lower shield assemblies by mounting pins 155 and guidably slidably engaging each other by means of a plurality of downwardly projecting tapered pegs 156 provided on the upper shield assembly 150 slidably engaged in tapered recesses 159 provided on the lower shield assembly 152. The reason for the tapered pegs will be made clear later in the specification. The pegs and recesses also are shown in FIGS. 22, 23 and 25. In total there are at least two pegs and two recesses on each side of the machine but in any one drawing not all the recesses and pegs are same.

The lower shield assembly 152 is made up of a plurality of sections having curved outer surfaces for engagement with the rock face. The lowermost sections define a track 160 (see FIG. 19) adapted to carry a scraper chain conveyor (not shown) for conveying rock cut by the cutter head 9 longitudinally through the machine towards further conveyor means (not shown) for example a belt conveyor or mine cars for transporting the cut rock along the roadway or tunnel and away from the working face. The sections of the lower shield assembly are provided with a rearwardly projecting shield component 153 which together with a similarly rearwardly projecting shield component 149 on the upper shield assembly 150 provide a continuous shield ring within which the rings of supports 12 are erected. The sections of the lower shield assembly are provided with the previously mentioned hydraulic rams 14 (see FIGS. 1, 2, 20 and 32) which are housed in the rearward facing portions of the sections and which are arranged to abut the last erected support 12 within the rearwardly projecting shield components 153, 149 which then constitute a buttress against which the excavating machine including the whole of the outer shield assembly 10 can be advanced along the roadway towards the newly exposed working face 2.

During advance of the outer shield assembly 10 the excavating machine can be horizontally steered by the action of two pairs of opposed thrust pads 162 which can be urged outwards into contact with the rock face by hydraulic rams 164 and which are guidably and slidably mounted in recesses 165 provided in the sides of the lower shield assembly. The machine is steered vertically under the action of two thrust pads 167 (omitted in FIG. 18 but shown in FIG. 20) which are guidably and slidably mounted in recesses 166 (see particularly FIG. 18) provided in the base of the lower shield assembly and which are urged towards the rock floor of the roadway or tunnel by hydraulic jacks (not shown) in similar manner to the action of the rams 164 on the thrust pads 162.

The forwardmost portion of the lower shield assembly 152 is provided with a plurality of forwardly tapering rigid ramp sections 170 arranged to move over the rock floor and lower wall surfaces when the machine is advanced and to guide rock cut from the working face towards the conveyor track 160.

Figure 16:
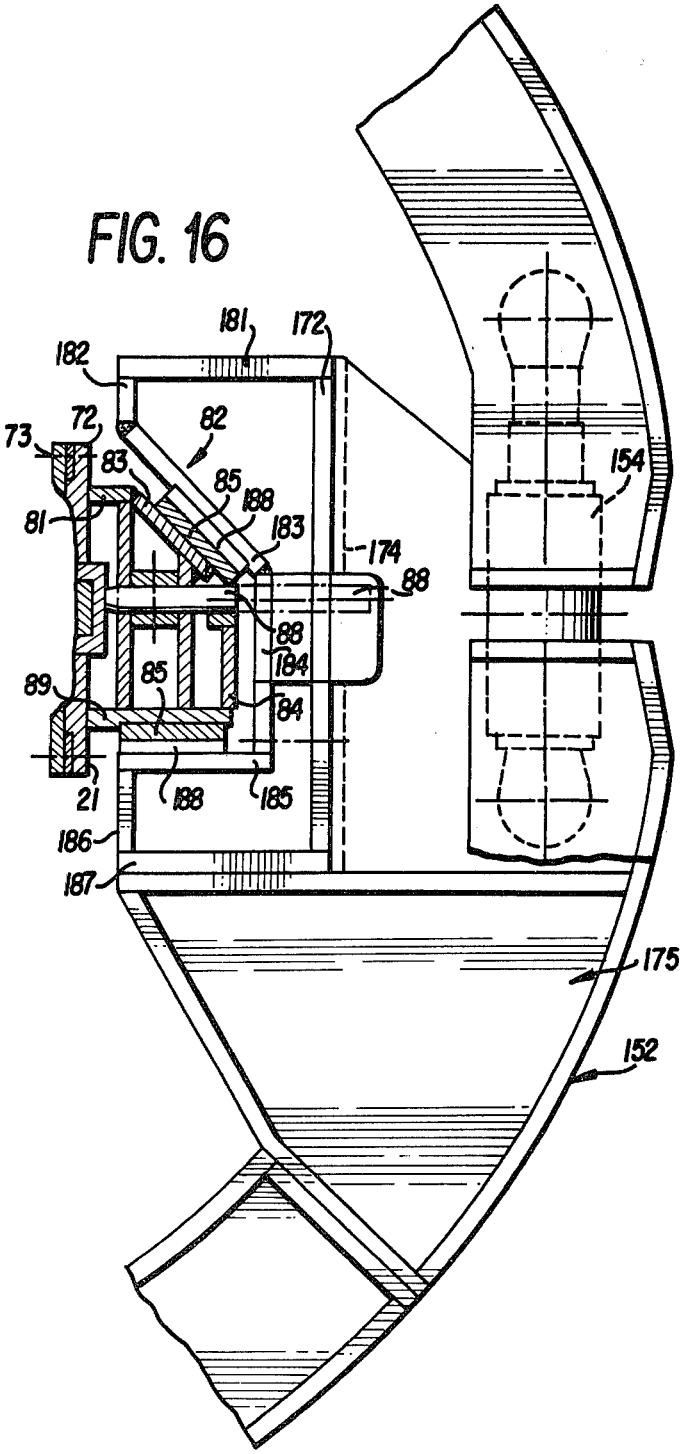
FIG. 16 is an incomplete section along line XVI—XVI of FIG. 15.

FIGS. 19 and 20 show how the two slideway components 82 are mounted on the lower shield assembly 152, the horizontally outermost vertical plate 172 of each slideway component being fixedly secured by bolts 173 (see FIGS. 22, 24, 25 and 26) to a respective vertical plate element 174 firmly secured to the uppermost section 175 of the lower shield assembly. Each slideway component 82 also comprises a plurality of plates 181, 182, 183, 184, 185, 186, and 187 welded together to form an open sided trough guide for engagement with the associated slide component 70. The lower horizontal plate 187 is secured to the lower shield assembly by bolts 169. FIGS. 4, 5 and 16 indicate how the slide and slideway components engage. The slide pads 85 on the slide component 20 slidably engage the slide pads 188 on the slideway component 82. The two inclined plates 183 of the two slideway components and the two open sides of the two slideway components face one another so the two slide components fixedly mounted on the cutting unit assembly can firmly wedge into the slideway components under the action of the wedge arrangements 100, 102 which as previously mentioned are arranged to take up any tolerance clearances when actuated.

The rearmost portions of the slideway components 82 are interconnected by a supporting brace 200 (see FIGS. 19 and 20 bridging across the slideway components in the region of the anchor means 75. The brace is secured by bolts (not shown) to the uppermost plate 181 of the slideway component.

FIGS. 19, 20, 24 and 25 show that the uppermost outer margin 201 of the lower shield assembly 152 and the adjacent lowermost outer margin 202 of the upper shield assembly 150 are cut away so that the outer shield assembly 10 tapers inwardly along its mid side portion. This form of construction is to assist horizontal steering of the machine and to help prevent the outer shield assembly 10 becoming wedged in the roadway or tunnel as the upper shield assembly is repeatedly reset to its supporting and stay position as the machine is advanced in stages towards the newly exposed working face 2.

Figure 31:
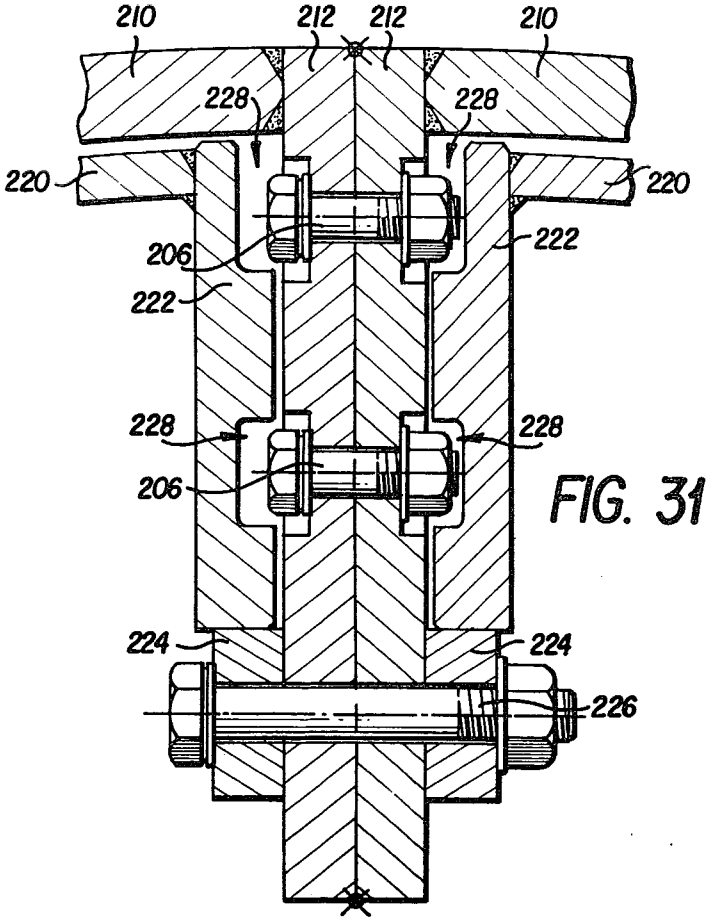
FIG. 31 is an incomplete section through a right hand side portion of FIG. 29 drawn on an enlarged scale.
Figure 30:
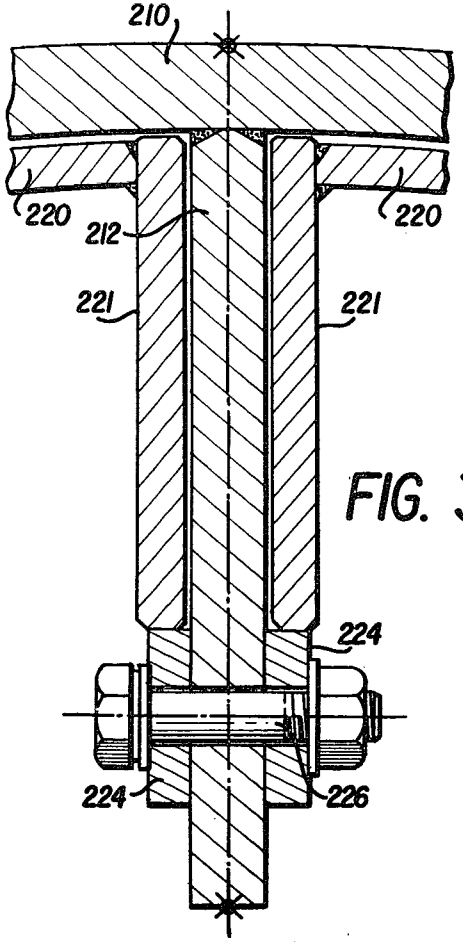
FIG. 30 is an incomplete section through a left hand side portion of FIG. 29 drawn on an enlarged scale.

The upper shield assembly 150 comprises a plurality of assembled sections rigidly secured together by bolts, for example, bolts 206 in FIG. 31. The remainder of the securing bolts are not shown for the sake of clarity. Each section comprises an outer curved plate 210 and a plurality of radially inwardly extending plates 212 which together define a plurality of box compartments 214. The uppermost plate 210 extends over two box compartments arranged on opposite sides of a vertical plain extending through the longitudinal axis of the outer shield assembly. The adjacent radial plates 212 of these of the two box components are not bolted together and are spaced from one another allowing limited articulation between the two halves of the upper shield assembly 150 located on opposite sides of the vertical plain through the longitudinal axis of the outer shield assembly. As will be explained later in the specification this articulation is necessary in order for the upper shield assembly 150 to afford efficient support of the newly exposed surface of the roadway or tunnel.

Figure 29:
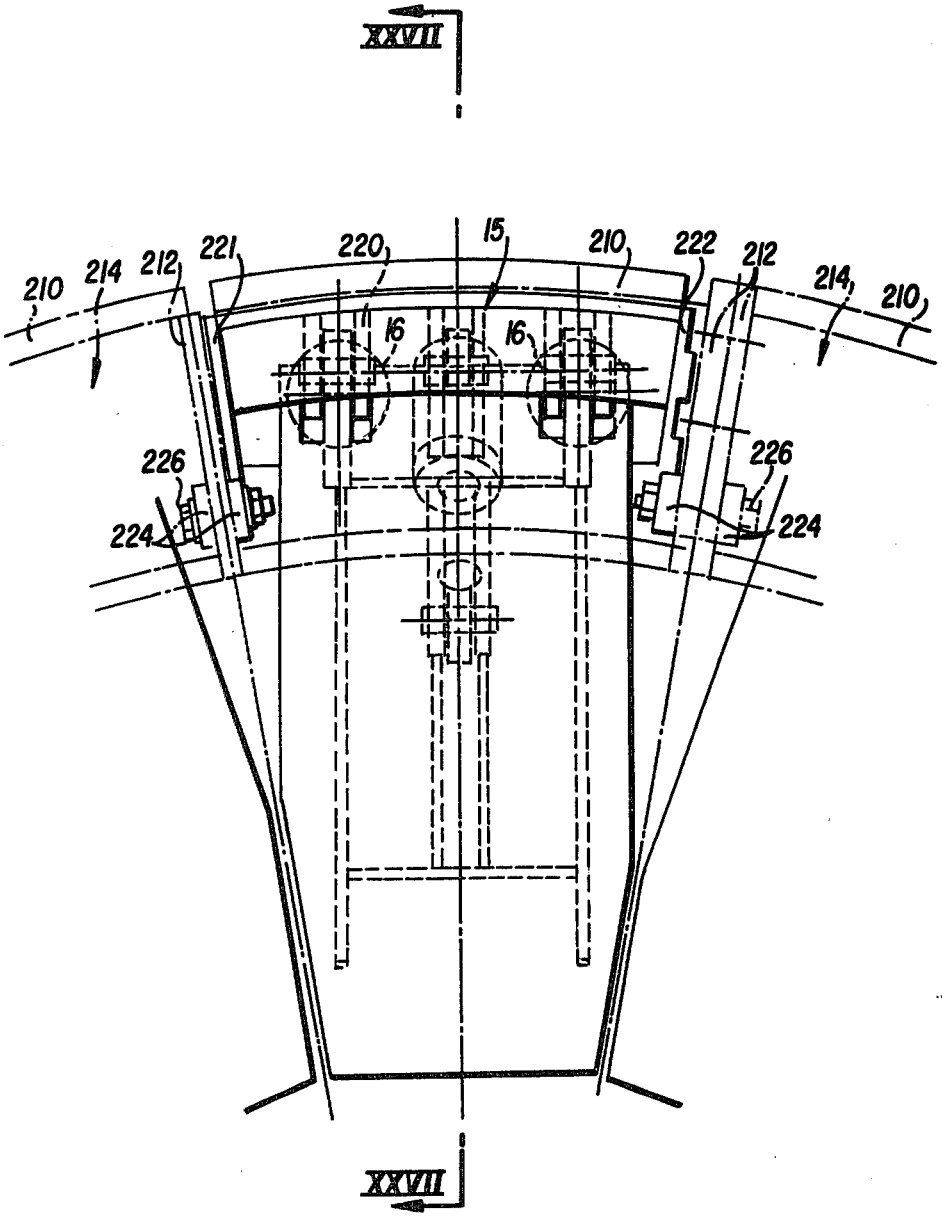
FIG. 29 is a front view of the detail of FIG. 27.

The box compartments provided on the leading part of the upper shield assembly 150 constitute a forwardly directed canopy, each of these leading box compartments is open ended at the front to permit the previously mentioned forepoling beam arrangements 15 to be projected forwardly towards the newly formed working face 2 to provide rapid cover of the newly exposed rock faces. Each forepoling beam arrangement comprises three longitudinally extending plates 220, 221 and 222 welded together to form an open bottomed trough shaped member. As seen in FIG. 29 the radially outer plate 220 is curved to cooperate with the adjacent previous mentioned outer curved plate 210. The two radially extending plates 221 and 222 lies adjacent to the radially extending plates 212 and are slidably supported on guide elements 224 secured by bolts 226 to the radially extending plates 212. The radially extending plates 222 are provided with two longitudinally extending recesses 228 (see FIG. 31) to allow clearance for the bolts 206 securing adjacent sections of the upper shield assembly together as previously explained.

Figure 27:
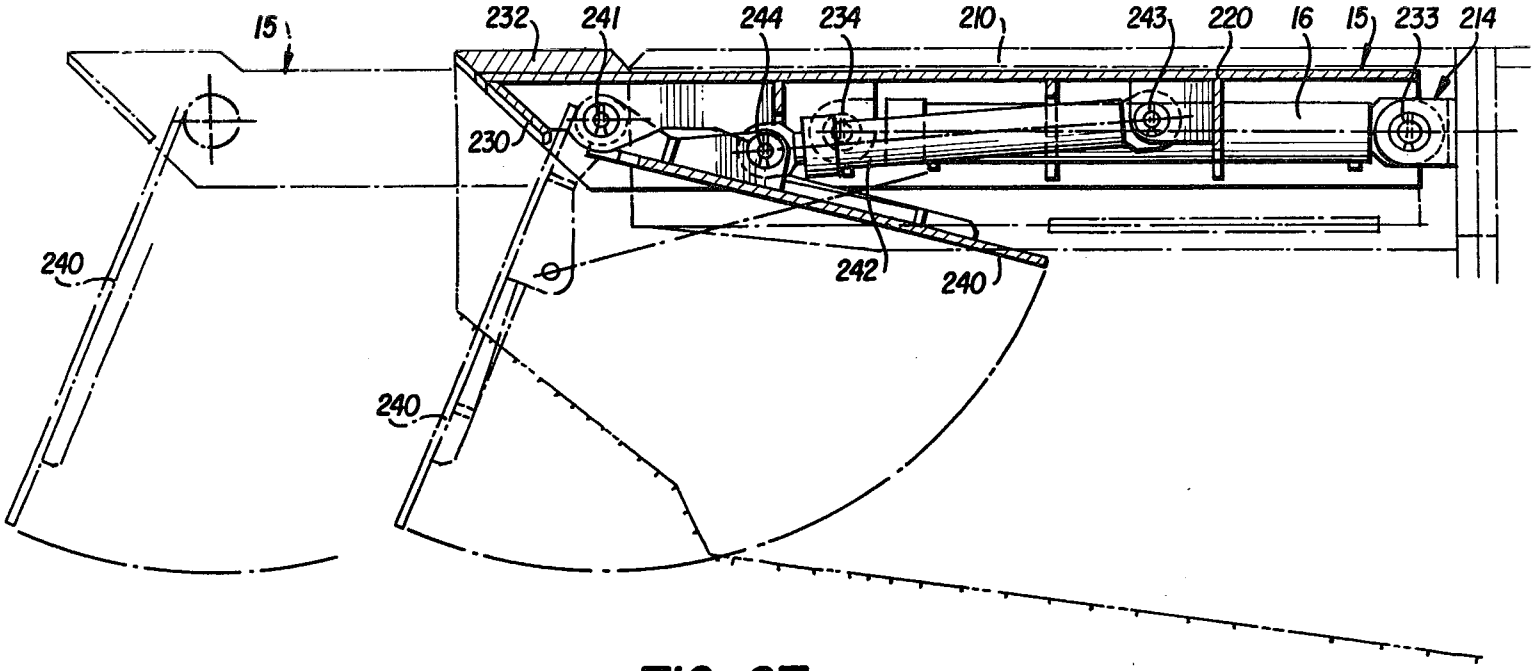
FIG. 27 is a section along line XXVII—XXVII of FIG. 29 showing a detail of FIG. 18 on an enlarged scale.
Figure 28:
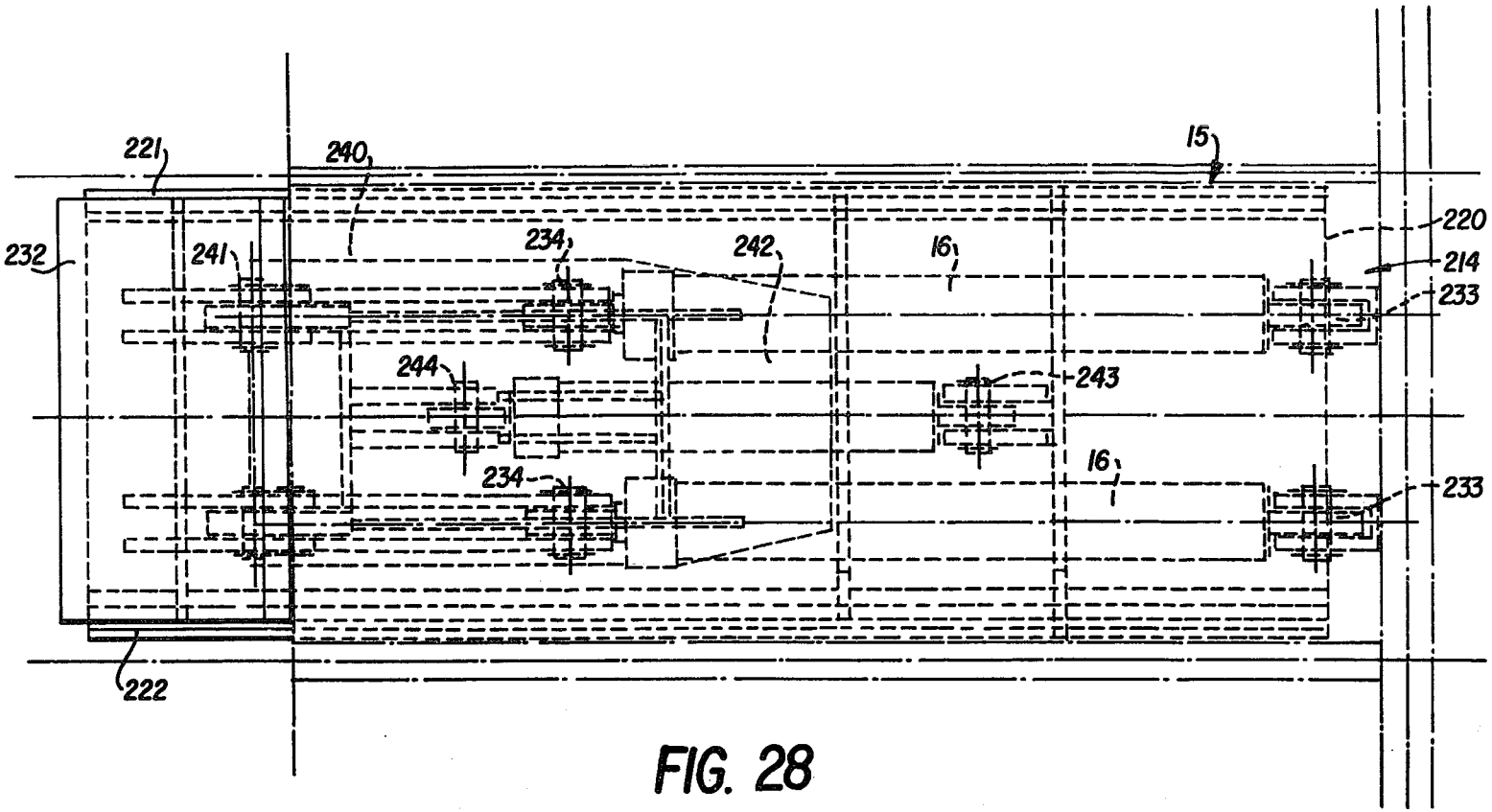
FIG. 28 is a plan of the detail of FIG. 27.

The front of the forepoling beam arrangement 15 has a cross plate 230 which co-operates with a blade 232 secured to the plate 220 to provide a rock chisel arrangement to break off any fillets of rock which unavoidably may be left on the rock face by the cutter 9. Each forepoling beam assembly 15 is slid forwardly with respect to the remainder of the canopy by a pair of hydraulic rams 16 mounted in pivotal mountings 233 and 234 provided on the associated box compartment and outer plate 220, respectively. In FIG. 27 the forepoling beam arrangement 15 is shown in full line in its withdrawn position within the box compartment and in broken line in its forwardly projected position shielding the newly exposed rock face. Each forepoling beam arrangement 15 also comprises a flap plate 240 pivotally supported in a pivotal mounting 241 for movement about a generally horizontal axis, pivotal movement of the flap plate being controlled by the action of a hydraulic ram 242 located in pivotal mountings 243 and 244 provided on the flap plate and outer curved plate 220, respectively. The flap plate can be closed towards the canopy (as shown in full line in FIG. 27) to permit the boom 6 to fully transverse the working face and can be opened into a generally vertical position (as indicated in broken lines in FIGS. 27 and as shown in FIG. 29) where it supports the newly exposed vertical working face 2.

When all the flap plates are open they provide an effectively continuous shield extending over substantially over the whole of the upper one half of the exposed working face.

In operation the outer shield assembly 10 is installed in the roadway or tunnel to be extended with the cutter head 9 of the horizontally projecting cutting unit assembly arranged to the working face 2. With the pin 95 of the adjustable anchor means 75 engaged in the bore 97 in the rod 93 and the ram 87 fully retracted the rams 154 between the upper and lower shield assemblies 150 and 152 are pressurised to urge the uppermost portion of the upper shield assembly towards the roof of the rock face of the roadway or tunnel. Once the uppermost portion contacts the rock roof the rams 154 are further pressurised causing the two halfs of upper shield assembly to articulate about its central axis so that the two outer end margins 201 are urged outwardly into contact with the rock walls of the roadway or tunnel. During the movement of the upper shield assembly the tapered pegs 156 first move upwardly within the tapered recesses 158 until the uppermost portion contacts the roof and then move outwards within the recesses 159 until the walls are contacted by the end margins 201 and substantially the whole of the rock face is engaged by the outer shield assembly 10. Throughout this movement the pegs, and thereby the upper shield assembly, are guided within the recesses in the longitudinal directional such that the upper shield assembly moves vertically relatively to the lower shield assembly. Once the rams 154 are fully pressurised the outer shield assembly 10 is firmly anchored within the roadway or tunnel to provide a stay for the cutting unit assembly which is then advanced along the slideway components 82 by the action of the extending rams 87. During advance of the cutting unit assembly the cutter head 9 is rotated so that it sumps into the adjacent part of the working face 2. Once the rams 87 are advanced one half of their full extent and the cutter head is fully sumped into the working face the rams 106 and 110 of the wedge arrangements 100 and 102 are pressurised to move the wedge pads 104 and 108 relatively to the reaction wedge members 105 and 109 until they engage the wear pads 188 on faces 185 and 183, respectively, to take up any tolerance clearances between the slide components 70 and the associated slideway components 82 thereby tending to fix the cutting unit assembly relatively to the slideway components 82 and hence to the outer shield assembly. The cutting unit assembly is constructed and arranged on the slideway components 82 such that the slide components 70 tilt forwardly such that when the rams 106 are pressurised they urge the associated wedge pads 104 into the gaps existing at the lower margins of the rearmost portions of the tilted slide components. Thus, the wedge pads 104 take up all the tolerence clearances existing at the rearmost portion of the slide components. Similarly, pressurisation of the rams 110 moves the wedge pads 108 into the gaps existing at the upper margins of the forwardmost portions of the tilted slide components 70. Thus, the wedge pads 108 take up all the tolerance clearances existing at the forwardmost margins of the slide components.

The rams 106 and 110 are pressurised to move the wedge pads 104 and 108 at a relatively low pressure say for example three hundred pounds per square inch. The same rams can be pressurised to withdraw the wedge pads 104 and 106 at a much higher pressure, say for example two thousand pounds per square inch.

The wedge pads 108 move to take up clearances such that the wedge arrangements 102 act on the opposed inclined plates 183 tending to anchor the slide components 70 and thereby the cutting unit assembly against horizontal movement. Although the wedge arrangements 100 and 102 tend to fix the slide components 70 to the slideway components 82 any substantial cutting reaction forces tending to urge the cutting unit assembly longitudinally along the slideway components 82 are resisted by the rams 87 which during cutting are subjected to a hydraulic lock.

Once the body 5 is firmly anchored by the staying action of the hydraulically locked rams 87 and of the wedge components, the two pairs of rams 7 and 8 are activated to pivot the boom 6 about the horizontal trunnion 58 to raise the sumped in rotating cutter head 9 midway towards the desired uppermost extent of the working face 2. The hydraulic motors 27 then are activated to rotate the gear wheels 30 urging the gear ring 34 and thereby the leading portion 36 of the body 5 to rotate about the bearing 42 and sweep the boom 6 and the cutter head 9 in an arc of three hundred and sixty degrees until the cutter head once again reaches the initial mid way position. The rams 7 and 8 then are actuated to raise the cutter head 9 towards the desired uppermost extent of the working face 2. The hydraulic motors 27 are then reversed to rotate the leading portion 36 of the body three hundred and sixty degrees in the opposite direction until the cutter head once again reaches the uppermost extent of the working face 2.

The cutter head 9 then is returned to its central position with the boom 6 extending horizontal before the rams 242 and 16 are pressurised to open the flap plates 240 and to urge the beam arrangements 15 towards the working face 2. Thus, the upper portion of the newly exposed working face and roadway or tunnel roof is shielded and adequately supported.

The wedge arrangements 100 and 102 are then activated at an intensified pressure, if necessary, to release the slide components 70 allowing the rams 87 to extend fully to further advance the slide components 70 along the slideway components 82 to once again sump the rotating cutter head 9 into the newly formed working face. The flap plates 240 are closed and the whole of the above described cutting operation is repeated to cut a further strip from the working face 2 to further advance the roadway or tunnel. It should be noted that the electric supply cable for the cutter head drive motor within the housing 65 is given an initial twist of one hundred and eighty degrees so that during cutting the cable is never subjected to a total twist in either direction of rotation of more than one hundred and eighty degrees.

Once the strip has been completely cut from the working face the flap plates 240 are re-opened and the beam arrangements 15 further advanced to shield the newly exposed roof and provide adequate face support.

The wedge arrangements 100 and 102 are activated to release the slide component 70 from the slideway component permitting the rams 87 to withdraw fully the cutting unit assembly. At this stage the cutter head 9 has been withdrawn from the newly exposed working face by a distance equal to two working strokes of the advancing rams 87.

The outer shield assembly 150 then is released from its roof supporting position by retracting rams 154, the tapered pegs 156 first permitting the outer margins 201 to move inwards from the rock face, the uppermost outer curved plate permitting the necessary articulation between the two halves of the upper shield assembly. Further retraction of the rams 154 releases the uppermost portion of the upper shield assembly from the roof of the roadway or tunnel.

The whole of the excavating machine then is advanced by pressurisation of the rams 14 arranged around the rear of the lower shield assembly 152 which abut the previously set ring of roof support sections 12 constituting a buttress for the rams 14. The machine is advanced until the cutter head abuts the newly exposed working face. As the outer shield assembly is advanced with the rest of the machine the telescopic beam arrangements 15 remain abuting the working face and are urged into a retracted position against the action of the rams 16. Thus, the newly exposed upper working face and roof are adequately shielded throughout the advance of the machine.

Once the cutter head abuts the working face advance of the machine is halted and the outer shield assembly is reset to its roof supporting stay position under the action of the extending rams 154. The whole of the previously described cutting procedure is then repeated.

When the outer shield assembly is reset to its stay position the rams 14 are withdrawn back into the lower shield assembly 152 and a further ring of roof support sections 12 is erected within the rearwardly projecting shield components 149 and 150 at the rear of the outer shield assembly and abutting the previously erected ring of sections. The sections which are reinforced concrete are conveyed along the roadway or tunnel towards the erector 11 (see FIGS 1 and 2) on the machine by rail mounted trolleys (not shown). The sections are lifted from the trolley by the erector which comprises a winch arrangement and which hauls the sections around the roadway or tunnel wall until the ring is complete, erection taking place within the protected zone defined by the rearwardly projecting shield components 149, 153. Typically, the ring comprises about seven or eight sections which are locked in position by a central wedge element. Once the ring of sections is complete and the outer shield assembly advanced a rapid setting cement is pumped behind the sections to ensure a good supporting engagement between the rock face and the supporting sections.

The whole cutting, advancing and section erecting procedures are repeated until the roadway or tunnel is excavated to its desired length.

We claim:

1. An excavating machine for excavating rock from a working face to extend an underground roadway or tunnel, comprising a stay unit anchorable in the roadway or tunnel and having a slideway which when the stay unit is installed in the roadway or tunnel extends longitudinally along the roadway or tunnel, and a cutting unit assembly slidably supported on said stay unit comprising a body and a boom adapted to carry a rotary cutter for excavating rock from the working face, the body comprising a non-rotary portion presenting annular support means which are arranged generally coaxially with the longitudinal axis of the roadway or tunnel, and a rotary portion provided with a pivotal mounting for pivotally supporting the boom and having annular supported means for cooperation with the annular support means of the non-rotary portion of the body, one of the portions comprising a single gear ring assembly for drivable engagement by at least one driven gear wheel to rotate the rotary portion relative to the non-rotary portion, the annular support means, the annular supported means and the gear ring assembly substantially located adjacent to a radially outer margin of the body and in a common transversely extending plane, the non-rotary portion of the body further comprising a slide arrangement for slideable engagement with said slideway of the stay unit, the pivotally mounted boom having driven means for rotating the cutter, said cutting unit being slidable with respect to said stay unit whereby said cutting unit is advanced against a surface to be cut, cutting said surface to sump said cutting unit, means for urging said cutting unit away from said stay unit in opposition to cutting forces on said cutter only during the time said cutting unit is sumping into said surface, and means for fixing the position of said non-rotating portion with respect to said stay unit after said cutting head is sumped with respect to said surface.

2. An excavating machine as claimed in claim 1, in which the annular support means includes an annular bearing.

3. An excavating machine as claimed in claim 2, in which the non-rotary portion of the body comprises at least one drive motor and at least one driven gear wheel, and the rotary portion of the body comprises an annular gear drivably engageable by the driven gear wheel.

4. An excavating machine as claimed in claim 3, in which the radially outer margin of the non-rotary portion of the body presents an annular forwardly directed projection arranged to co-operate with an annular rearwardly directed projection presented by the radially outer margin of the rotary portion of the body.

5. An excavating machine as claimed in claim 4, comprising at least one seal provided between the co-operating projections.

6. An excavating machine as claimed in claim 1, in which a relatively radially inner margin of the non-rotary portion of the body presents a cylindrical formation which in use is arrangeable generally coaxially with the longitudinal axis of the roadway or tunnel, and the rotary portion of the body has an annular formation for co-operation with the cylindrical formation.

7. An excavating machine as claimed in claim 6, comprising at least one seal provided between the cylindrical and annular formations.

8. An excavating machine as claimed in claim 7, in which the or each drive motor is mounted on the rear of the non-rotary portion and an extended drive shaft drivably engages the driven gear wheel.

9. An excavating machine as claimed in claim 1, in which the rotary portion of the body comprises a trunnion for pivotally supporting the boom, the pivotal axis of the trunnion being transverse to, and arranged to intersect, the axis of rotation of the rotary portion.

* * * * *